US011788366B2

(12) United States Patent
Herndon

(10) Patent No.: US 11,788,366 B2
(45) Date of Patent: Oct. 17, 2023

(54) LINER DEPLOYMENT TOOL

(71) Applicant: Weatherford Technology Holdings, LLC, Houston, TX (US)

(72) Inventor: Jeffrey D. Herndon, Bakersfield, CA (US)

(73) Assignee: Weatherford Technology Holdings, LLC, Houston, TX (US)

( * ) Notice: Subject to any disclaimer, the term of this patent is extended or adjusted under 35 U.S.C. 154(b) by 0 days.

(21) Appl. No.: 17/404,819

(22) Filed: Aug. 17, 2021

(65) Prior Publication Data

US 2023/0056868 A1 Feb. 23, 2023

(51) Int. Cl.

| | |
|---|---|
| ***E21B 23/06*** | (2006.01) |
| ***E21B 33/12*** | (2006.01) |
| ***E21B 43/04*** | (2006.01) |
| ***E21B 43/08*** | (2006.01) |
| *E21B 43/10* | (2006.01) |

(52) U.S. Cl.

CPC ..... *E21B 23/06* (2013.01); *E21B 33/12* (2013.01); *E21B 43/045* (2013.01); *E21B 43/08* (2013.01); *E21B 43/10* (2013.01)

(58) Field of Classification Search

CPC ..... E21B 23/06; E21B 33/12; E21B 43/045; E21B 43/08; E21B 43/10

See application file for complete search history.

(56) References Cited

U.S. PATENT DOCUMENTS

| | | | | | |
|---|---|---|---|---|---|
| 3,072,204 | A | * | 1/1963 | Brown | E21B 43/045 166/212 |
| 3,710,862 | A | | 1/1973 | Young et al. | |
| 3,910,349 | A | * | 10/1975 | Brown | E21B 43/10 285/305 |
| 4,401,158 | A | | 8/1983 | Spencer et al. | |
| 4,583,593 | A | | 4/1986 | Zunkel et al. | |
| 4,834,185 | A | * | 5/1989 | Braddick | E21B 43/10 166/208 |
| 4,858,691 | A | * | 8/1989 | Ilfrey | E21B 43/088 166/278 |
| 5,048,606 | A | * | 9/1991 | Allwin | E21B 43/10 166/216 |
| 5,253,708 | A | * | 10/1993 | Alexander | E21B 10/322 166/278 |

(Continued)

OTHER PUBLICATIONS

Technical Sheet: "OTTO" Hydraulic Running Tool—Over The Top One Trip Gravel Pack System.

(Continued)

*Primary Examiner* — Steven A MacDonald

(74) *Attorney, Agent, or Firm* — Peter V. Schroeder; Booth Albanesi Schroeder, PLLC

(57) ABSTRACT

A gravel pack system includes a liner assembly and a deployment assembly. The liner assembly includes a sand control screen. The deployment assembly facilitates rotation of the liner assembly and circulation through the liner assembly while running the liner assembly into a wellbore using a work string. The deployment assembly includes a crossover tool that is operated to facilitate gravel packing without manipulation of the work string. The deployment assembly also includes a setting tool for setting a packer and/or a sand barrier at the top of the liner assembly.

12 Claims, 27 Drawing Sheets

(56) References Cited

U.S. PATENT DOCUMENTS 5,255,741 A * 10/1993 Alexander ..... E21B 43/04 166/278
5,332,038 A * 7/1994 Tapp ..... E21B 33/1293 166/278
5,425,423 A 6/1995 Dobson et al.
5,472,055 A 12/1995 Simson et al.
5,497,840 A * 3/1996 Hudson ..... E21B 7/20 166/278
5,597,040 A * 1/1997 Stout ..... E21B 43/26 166/51
5,746,274 A 5/1998 Voll et al.
5,823,254 A 10/1998 Dobson et al.
6,241,018 B1 6/2001 Eriksen
6,702,020 B2 3/2004 Zachman et al.
7,108,083 B2 9/2006 Simonds et al.
9,260,950 B2 2/2016 Broussard et al.
9,404,348 B2 8/2016 Yeh et al.
10,227,848 B2 3/2019 Castro et al.
2006/0076133 A1 4/2006 Penno
2006/0260795 A1 11/2006 Rescia
2020/0386083 A1 12/2020 Presslie et al.

OTHER PUBLICATIONS

Technical Sheet: Hydraulic Steel Seal Adapter "HSSA"—Metal to metal liner top sand control barrier for "OTTO" and "CBO" operations.
Technical Sheet: Hydraulic Steel Seal Adapter "HSSA"—Metal to metal liner top sand control barrier for One Trip Drill-in "OTD" operations.
Technical Sheet: "CBO" Hydraulic Running Tool—Circulating Backside One Trip Gravel Pack System.
Technical Sheet: "OTD" Hydraulic Running Tool—One Trip Drill-In Hydraulic Running Tool.

* cited by examiner

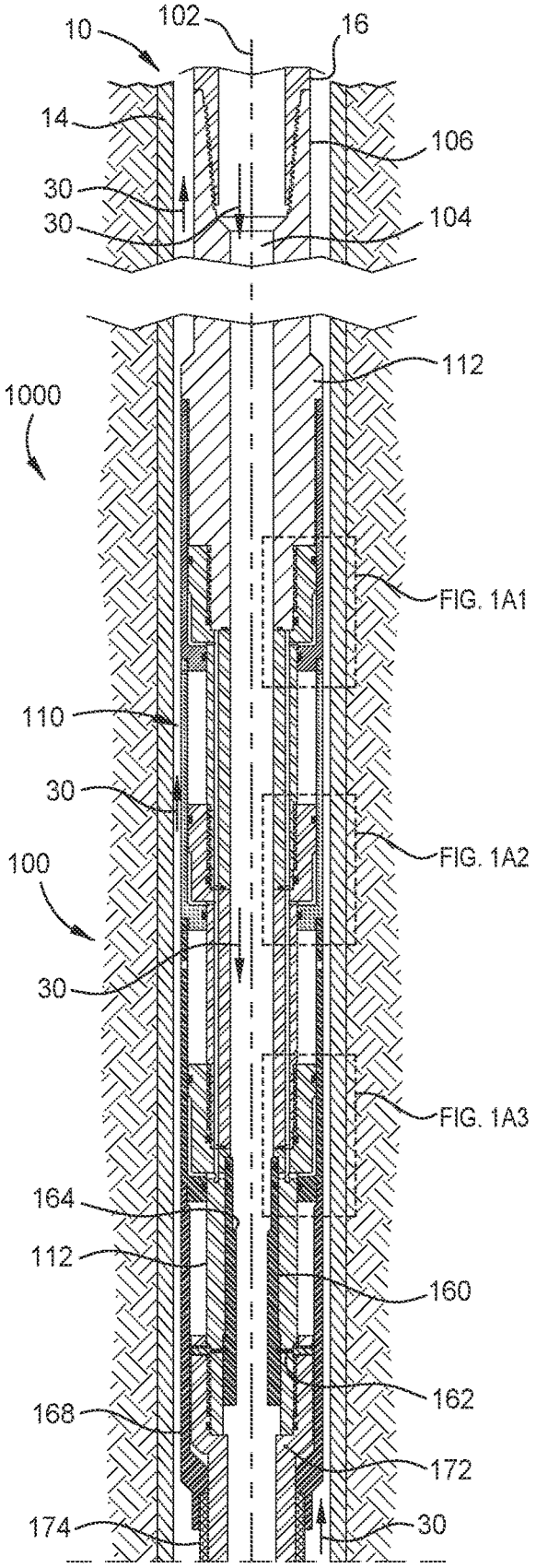
FIG. 1A
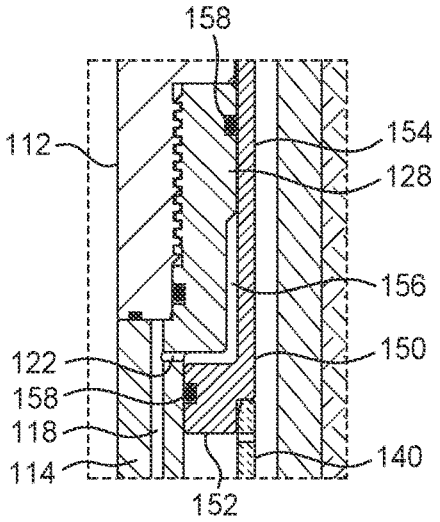
FIG. 1A1
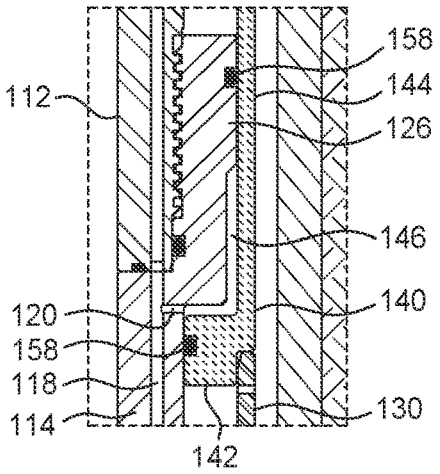
FIG. 1A2
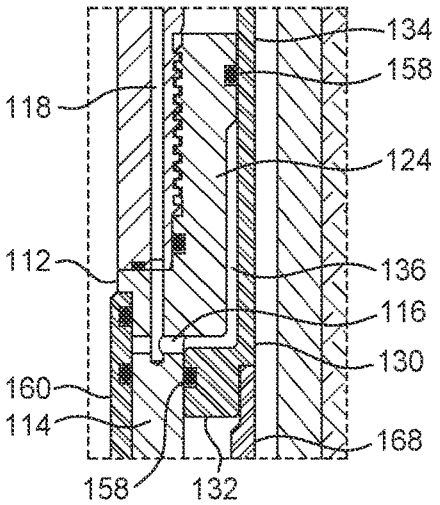
FIG. 1A3

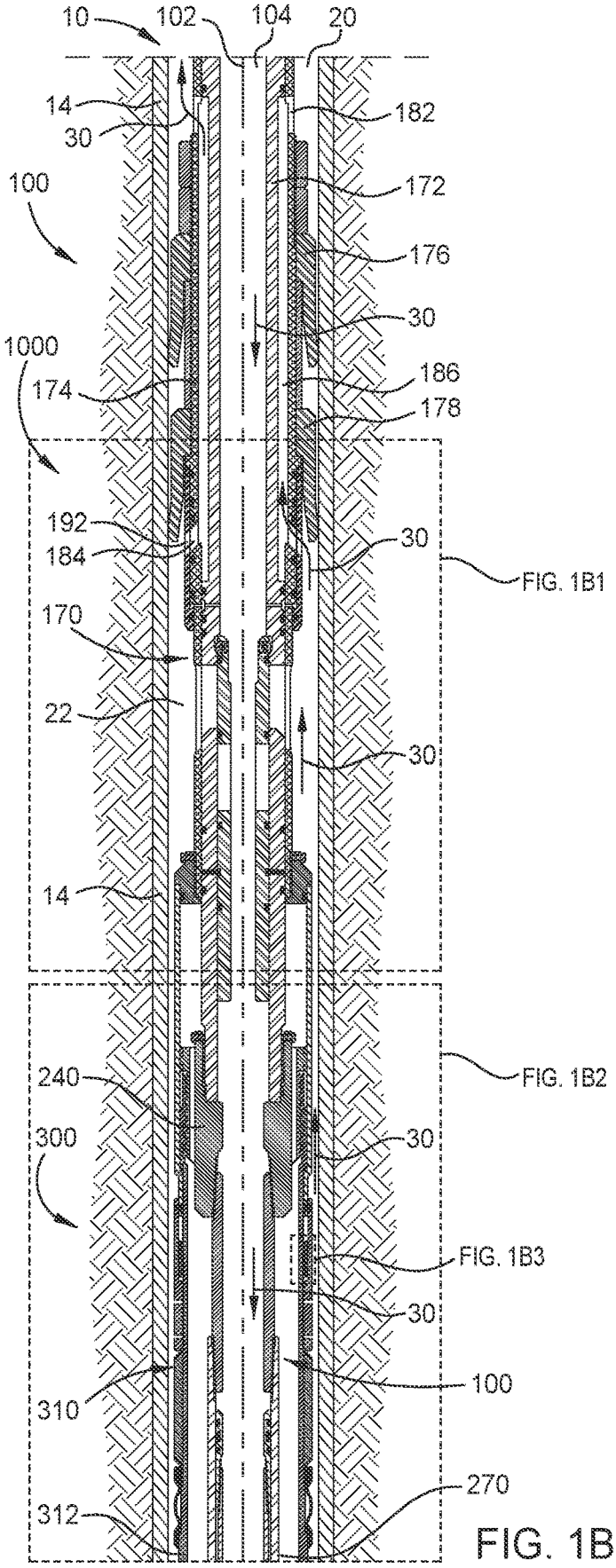
FIG. 1B
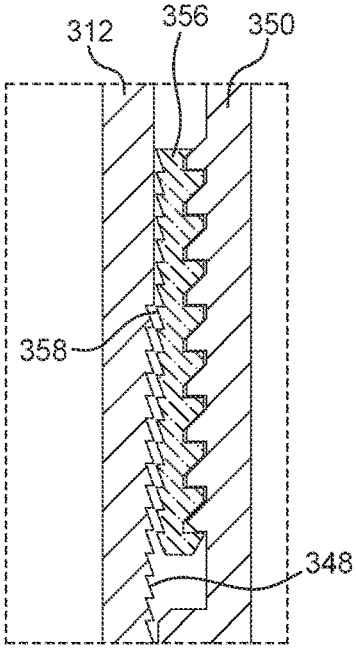
FIG. 1B3

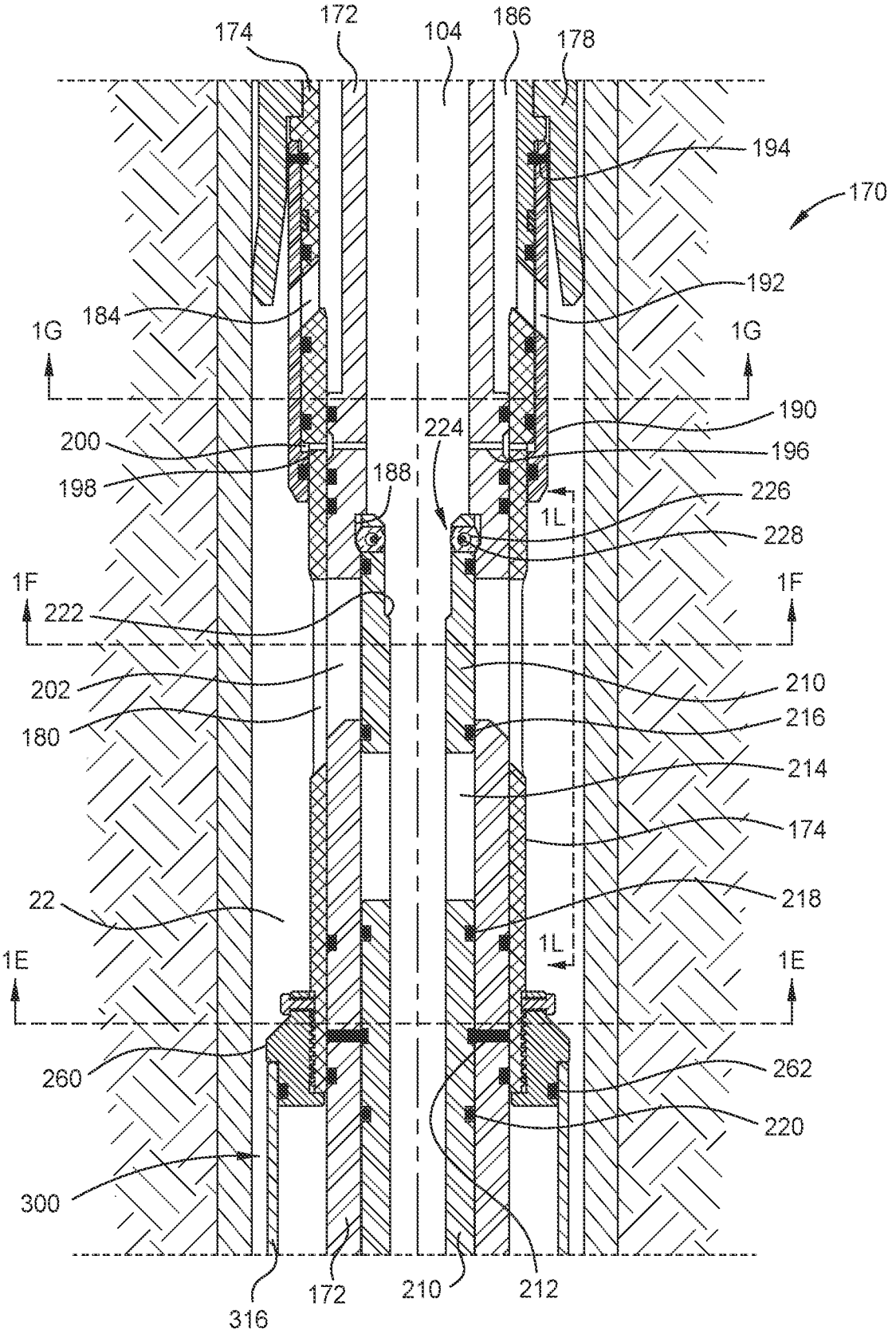
FIG. 1B1

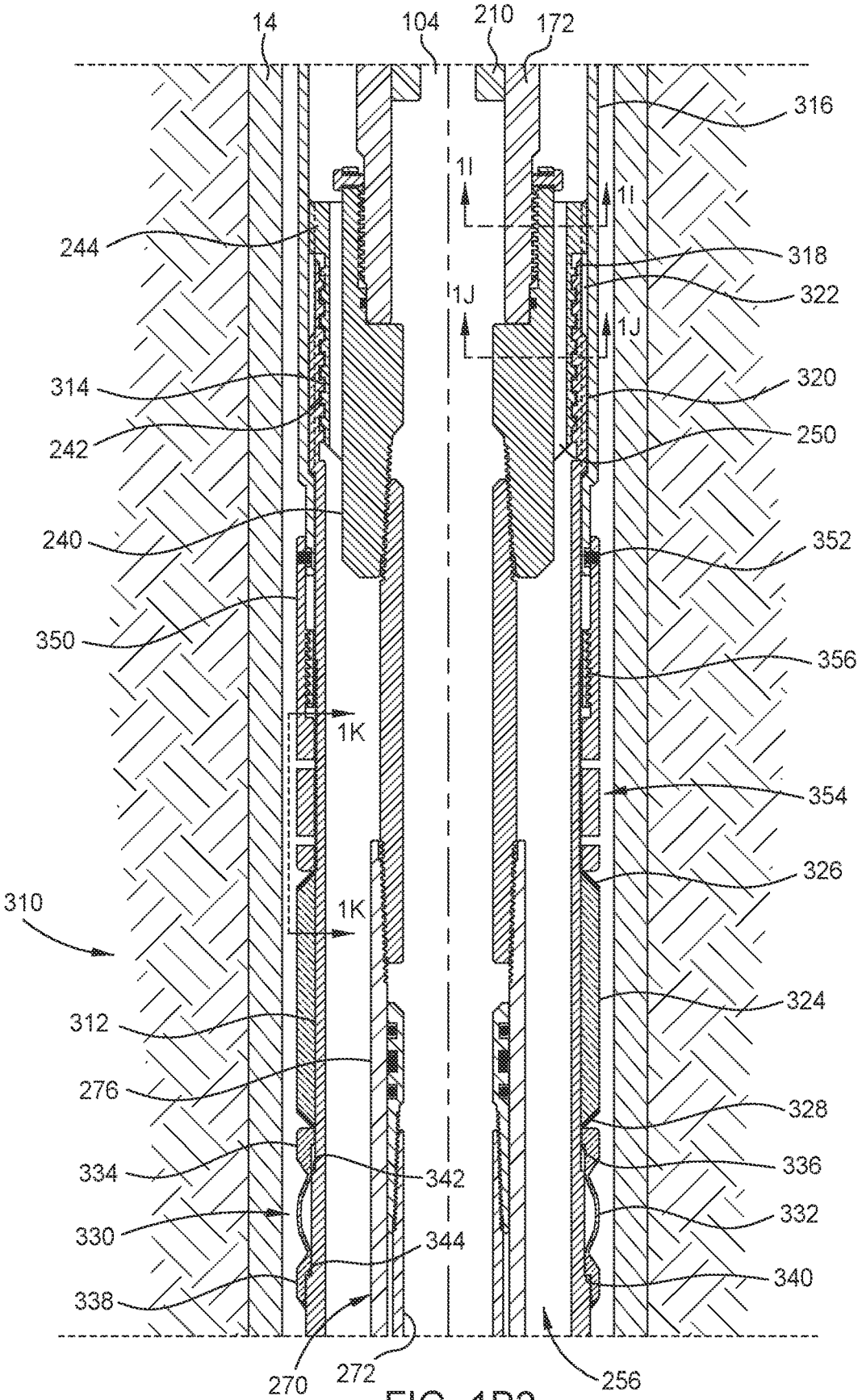
FIG. 1B2

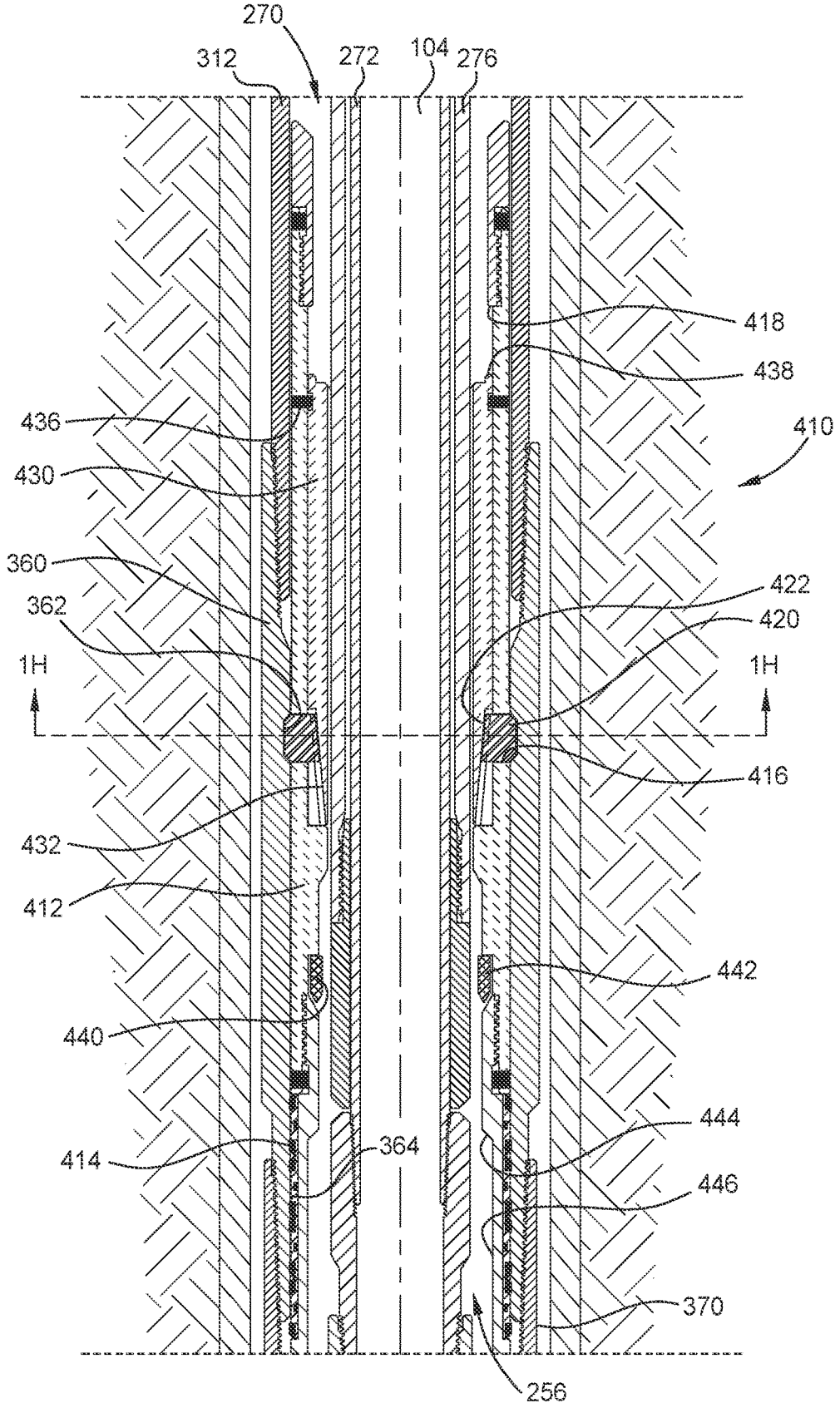
FIG. 1C1

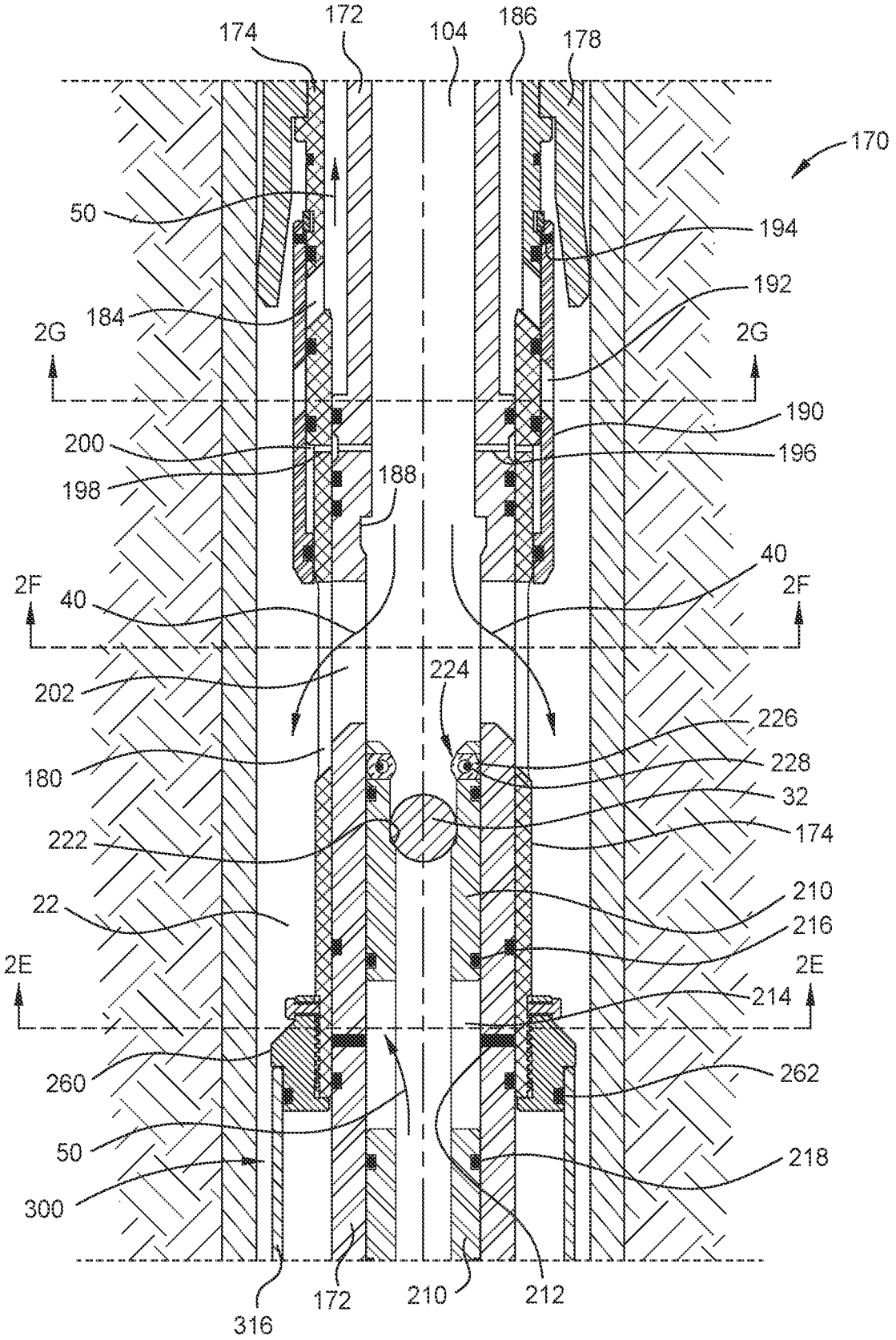
FIG. 2B1

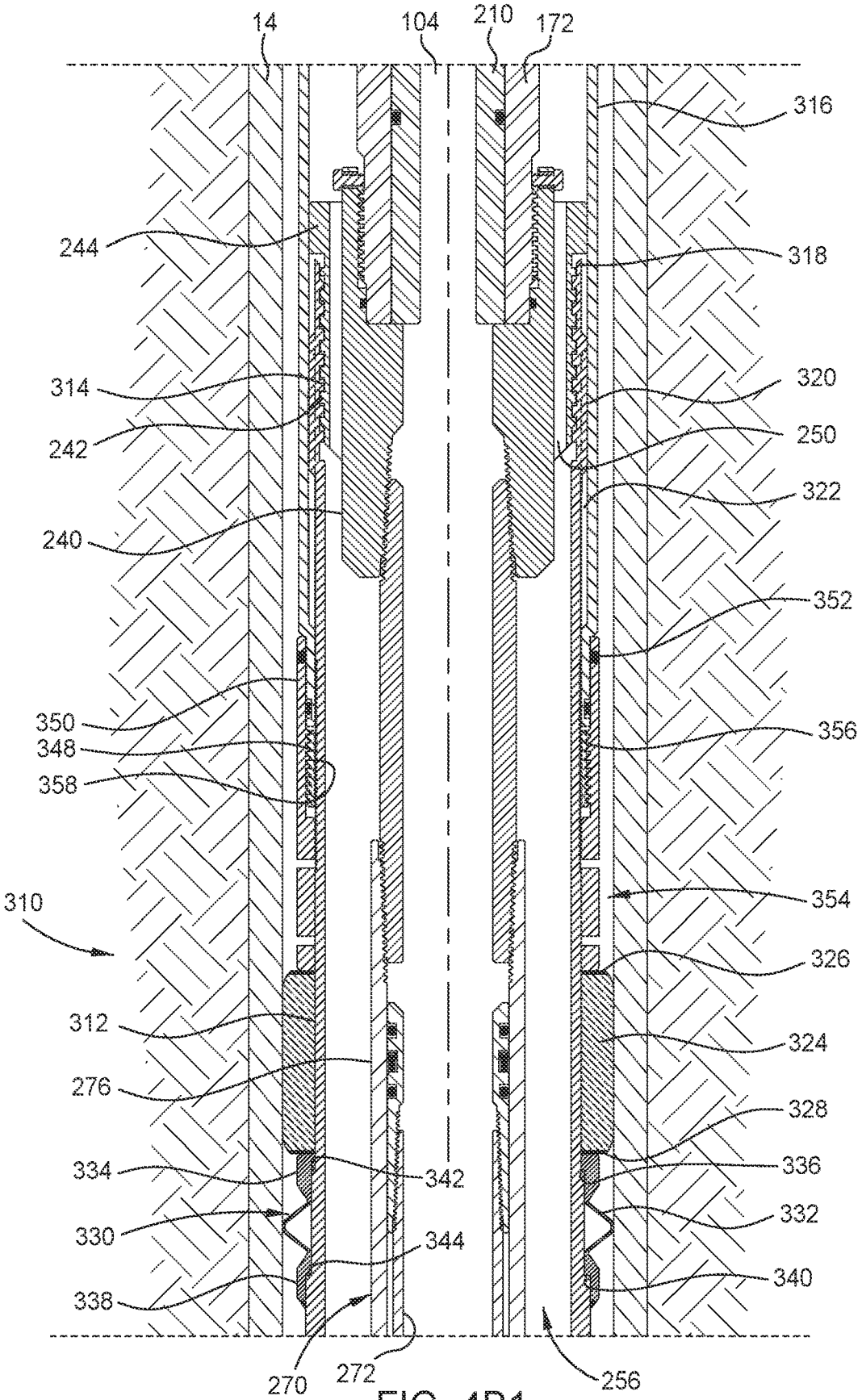
FIG. 4B1

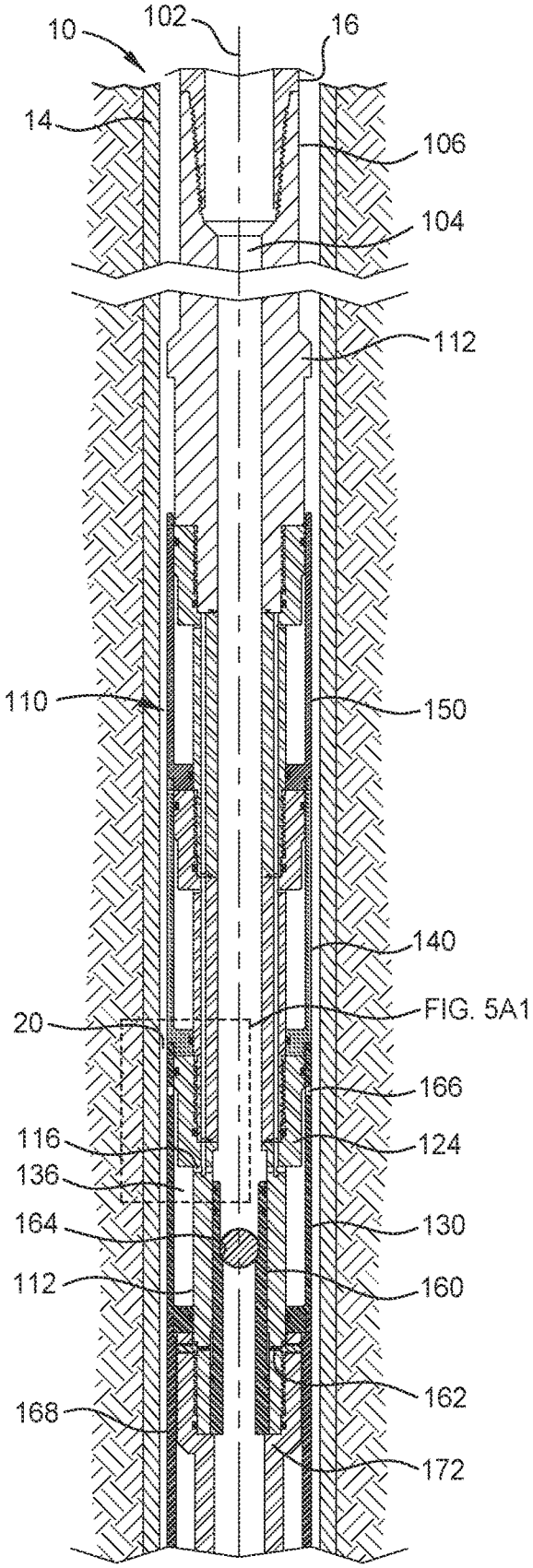
FIG. 5A
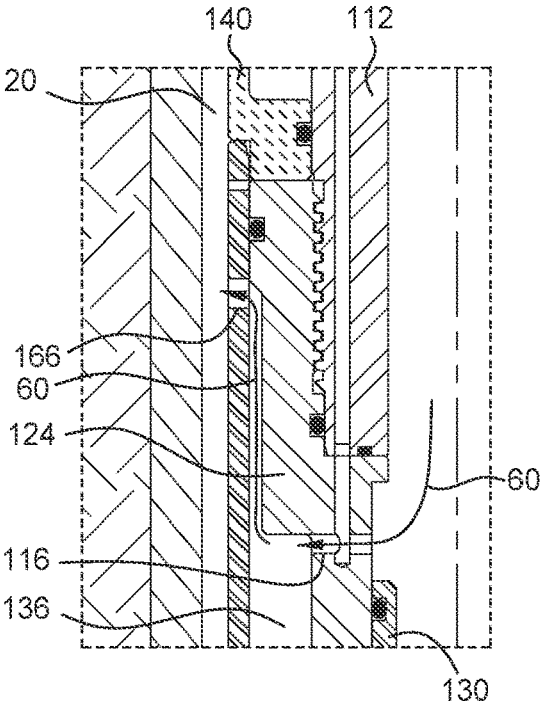
FIG. 5A1

LINER DEPLOYMENT TOOL

CROSS-REFERENCE TO RELATED APPLICATIONS

This application is related to U.S. patent application Ser. No. 17/404,775, filed on Aug. 17, 2021, which is herein incorporated by reference in its entirety.

BACKGROUND

Field

Embodiments of the present disclosure generally relate to systems and methods for deploying a liner in a wellbore.

Description of the Related Art

Particulates, such as sand, often are entrained with hydrocarbons produced from wellbores. The particulates originate from loose, unconsolidated, and/or fractured geological formations from which the hydrocarbons are produced. These particulates can cause a variety of problems, such as erosion of downhole and surface components. Operators use gravel packing as a common technique for forming a barrier downhole that is permeable to fluids but inhibits the production of such particulates.

A gravel pack involves the placement of particulate material, such as specially sized sand referred to as "gravel," into an annulus between a screen (and/or a slotted liner) and the surrounding geological formation. First, a liner assembly including a screen is lowered on a work string into a wellbore, and is placed adjacent the geological formation. Then gravel is pumped with a carrier fluid as a slurry down the work string. The slurry exits through a crossover tool into an annulus between the screen and the geological formation.

The carrier fluid in the slurry normally leaks off into the geological formation and/or through the screen itself. However, the screen is sized to prevent the gravel from flowing through the screen, resulting in the gravel being deposited or in the annulus between the screen and the geological formation to form a gravel pack around the screen. Then a packer at the top of the liner assembly is set to ensure the produced hydrocarbons flow through the gravel pack and the screen to filter out any mobile particulates from the geological formation.

Many wellbores are drilled at a high angle, horizontal, and/or in a tortuous path, resulting in difficulties in installing a screen at a desired downhole location. Typically, the running of a liner into a wellbore is enabled by deployment tools that facilitate the rotation of the liner and the circulation of fluids through and around the liner. However, such deployment tools do not include the capability to facilitate the placement of a gravel pack and the subsequent setting of a packer. Conversely, deployment tools that facilitate the placement of a gravel pack and the subsequent setting of a packer do not include the capability to rotate a liner while running the liner into a wellbore. Additionally, many crossover tools incorporated into gravel pack tools are operated by manipulation of the work string, which makes the entire liner running, gravel packing, and packer setting operation cumbersome.

Thus, there is a need for improved systems and methods that address the above problems.

SUMMARY

The present disclosure generally relates to systems and methods for deploying a liner in a wellbore.

In one embodiment, a liner deployment assembly includes a setting tool, a crossover tool coupled to the setting tool, and a liner running sub coupled to the crossover tool. The liner running sub includes a body. A first thread on the body is configured to engage a corresponding second thread of a liner assembly. A first spline on the body is configured to engage a corresponding second spline of the liner assembly. The first thread and the first spline are immovable relative to each other.

In another embodiment, a packer includes a packer mandrel including outwardly projecting splines. A sand barrier is disposed around the packer mandrel, and is movable between radially retracted and radially extended positions. A packer element is disposed around the packer mandrel adjacent the sand barrier. The packer element is movable between radially retracted and radially extended positions. A setting sleeve is disposed around the packer mandrel, and includes a spring section disposed adjacent the packer element. An actuation sleeve is coupled to the setting sleeve and is disposed around the packer mandrel. The actuation sleeve includes inwardly projecting splines engaged with the outwardly projecting splines.

In another embodiment, a method includes rotating a liner assembly in a wellbore by rotating a deployment assembly. The liner assembly includes a packer, a sand control screen, and a shoe. The method further includes circulating a fluid through the deployment assembly, out of the shoe, past the sand control screen, and past the packer. The method then further includes placing a gravel pack in an annulus between the sand control screen and a wall of the wellbore. The method further includes setting the packer by applying a pressure to a setting tool of the deployment assembly. The method further includes disengaging a radially inwardly projecting spline of the liner assembly from a radially outwardly projecting spline of the deployment assembly. The method then further includes disengaging the deployment assembly from the liner assembly by rotating the deployment assembly with respect to the liner assembly.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only exemplary embodiments and are therefore not to be considered limiting of its scope, as the disclosure may admit to other equally effective embodiments.

FIGS. 1A-1D provide a longitudinal cross-sectional view of a gravel pack system in an initial configuration during deployment in a wellbore.

FIGS. 1A1-1A3 provide enlargements of certain details of FIG. 1A.

FIGS. 1B1-1B3 provide enlargements of certain details of FIG. 1B.

FIG. 1C1 provides an enlargement of certain details of FIG. 1C.

FIG. 2B1 provides an enlargement of certain details of FIG. 2B.

FIG. 2C1 provides an enlargement of certain details of FIG. 2C.

FIG. 4B1 provides an enlargement of certain details of FIG. 4B.

FIGS. 5A-5B provide longitudinal cross-sectional views of portions of the gravel pack system of FIGS. 1A-1D during a subsequent operation in the wellbore.

FIG. 5A1 provides an enlargement of certain details of FIG. 5A.

To facilitate understanding, identical reference numerals have been used, where possible, to designate identical elements that are common to the figures. It is contemplated that elements and features of one embodiment may be beneficially incorporated in other embodiments without further recitation.

DETAILED DESCRIPTION

Figure 1C:
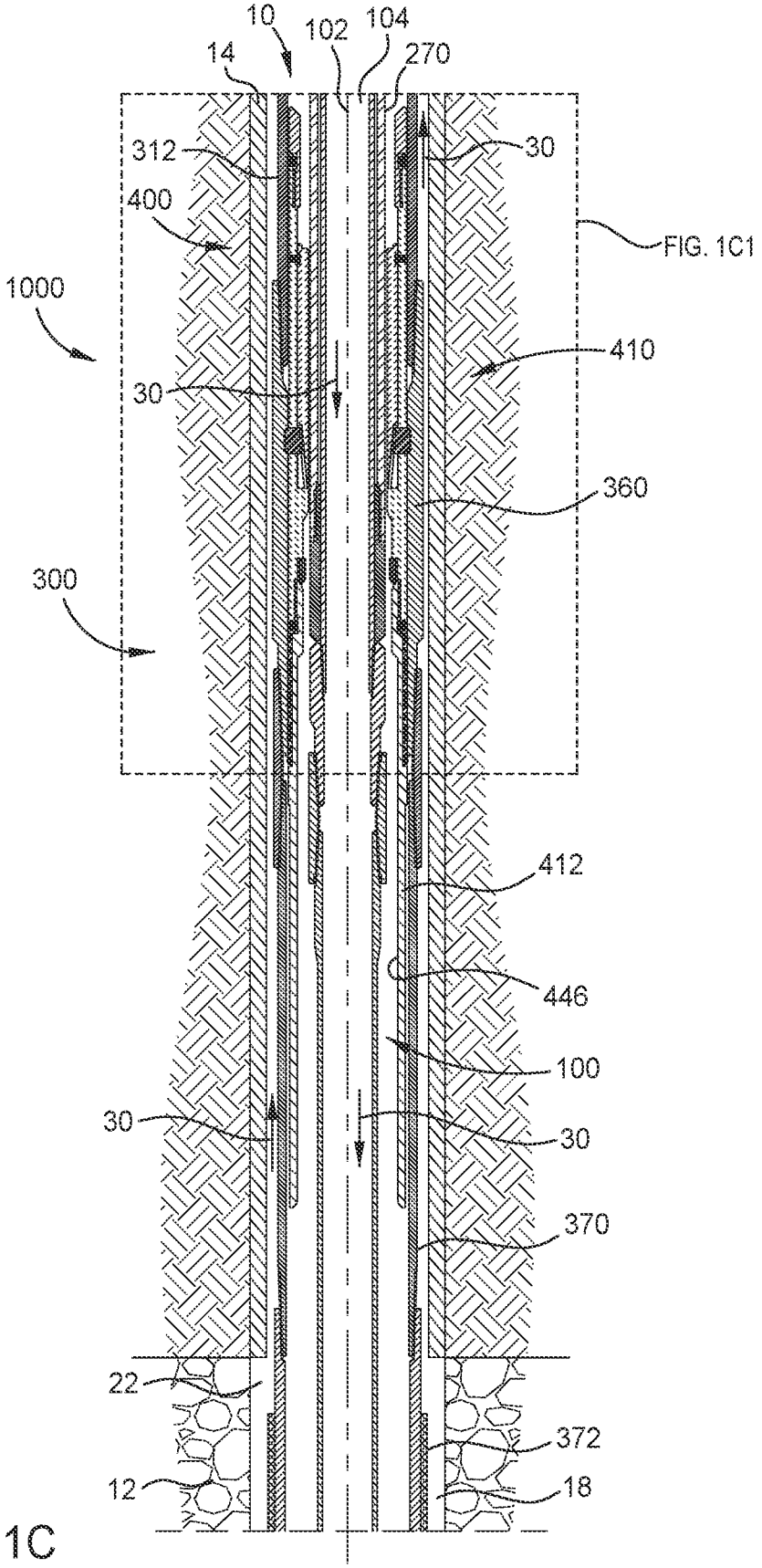

The present disclosure concerns systems, assemblies, and methods for deploying a liner in a wellbore. The systems, assemblies, and methods of the present disclosure can be used for a liner that includes sand control devices, such as slotted liners and screens. The systems, assemblies, and methods of the present disclosure facilitate rotation of, and circulation through, the liner while the liner is being run into a wellbore. The systems, assemblies, and methods of the present disclosure facilitate the placement of a gravel pack around the liner without manipulation of a work string after the liner has been positioned in the wellbore. The systems, assemblies, and methods of the present disclosure facilitate the setting of a packer at the top of the liner after the gravel pack has been placed around the liner. The systems, assemblies, and methods of the present disclosure facilitate the liner running, gravel packing, and packer setting operations in a single trip in the wellbore.

FIGS. 1A-1D provide a longitudinal cross-sectional view of a gravel pack system 1000 in an initial configuration during deployment in a wellbore 10. The wellbore 10 extends into a geological formation 12, and includes a casing 14. As shown, there is no casing within the geological formation 12, however in some embodiments, it is contemplated that the wellbore 10 may include a casing or liner at least partially within the geological formation 12.

In some embodiments, the gravel pack system 1000 includes a deployment assembly 100, a liner assembly 300, and an isolation assembly 400. In other embodiments, it is contemplated that the isolation assembly 400 may be omitted from the gravel pack system 1000. The liner assembly 300 includes a packer 310, a liner 370 including a sand control screen 372, and a circulating shoe 380. The deployment assembly 100 includes a setting tool 110, a crossover tool 170, a liner running sub 240, an expansion joint 270, and a gravel pack valve 280. In some embodiments, it is contemplated that the expansion joint 270 may be omitted. The isolation assembly 400 includes an isolator body 410 and an isolation packer 460.

FIGS. 1A-1D illustrate the gravel pack system 1000 positioned in the wellbore 10 with a portion of the liner assembly 300 adjacent the geological formation 12. An annulus 18 between the sand control screen 372 and the geological formation 12 is to be packed with particulate material, such as sand, in a gravel packing operation.

Deployment Assembly

The deployment assembly 100 includes a longitudinal axis 102 and a throughbore 104. A top connection 106 is configured for attachment to a work string 16, such as drill pipe or other tubulars. The deployment assembly 100 includes setting tool 110 that includes a setting tool mandrel 112. It is contemplated that the setting tool mandrel may be a single structure, or, as shown, may include multiple sections coupled together. Details of the setting tool 110 are shown in FIGS. 1A and 1A1-1A3. The setting tool mandrel 112 includes a wall 114 penetrated by a side port 116. A longitudinal bore 118 within the wall 114 intersects with the side port 116. Exit ports 120, 122 intersect with the longitudinal bore 118 in the wall 114. Bulkheads 124, 126, 128 extend radially outwardly from the setting tool mandrel 112. It is contemplated that the setting tool 110 may include any appropriate number of bulkheads, such as one, two, three, four, or more.

The setting tool 110 includes piston sleeves 130, 140, 150. Each piston sleeve 130, 140, 150 includes a piston head 132, 142, 152, respectively, and a skirt 134, 144, 154, respectively. Each piston head 132, 142, 152 is associated with a corresponding bulkhead 124, 126, 128, respectively. Seals 158, such as o-rings, are between each piston head 132, 142, 152 and the setting tool mandrel 112, and between each bulkhead 124, 126, 128 and a corresponding skirt 134, 144, 154, respectively. The setting tool 110 includes piston chambers 136, 146, 156, each piston chamber 136, 146, 156 bounded by a corresponding bulkhead and piston sleeve pairing 124 and 130; 126 and 140; 128 and 150; respectively.

Side port 116 provides fluidic access to piston chamber 136, and exit ports 120, 122 provide fluidic access to piston chambers 146 and 156, respectively. A sleeve 160 within the setting tool mandrel 112 blocks fluid communication between the throughbore 104 of the deployment assembly 100 and the side port 116, but is movable to open fluid communication to the side port 116. The sleeve 160 is temporarily held in the blocking position by one or more fastener 162, such as a latch, locking dog, collet, C-ring, snap ring, shear ring, shear screw, shear pin, or the like. The sleeve includes a seat 164 that is configured to receive an obturating object, such as a ball, a cone, a dart, a plug, or the like.

A setting sleeve 168 is disposed about the setting tool mandrel 112, and is adjacent the piston sleeve 130. The setting sleeve is movable with respect to the setting tool mandrel 112.

Transitioning from FIG. 1A to FIGS. 1B and 1B1-1B3, the setting tool 110 is coupled to crossover tool 170. The crossover tool 170 includes a crossover tool mandrel 172 that is coupled to the setting tool mandrel 112 of the setting tool 110. A cup sleeve 174 is disposed about the crossover tool mandrel 172, and is adjacent the setting sleeve 168 of the setting tool 110. Packer cups 176, 178 are disposed on the cup sleeve 174 between upper 182 and lower 184 diversion ports. The packer cups 176, 178 separate an upper annular zone 20 from a lower annular zone 22 that includes the annulus 18 between the sand control screen 372 and the geological formation 12. A diversion channel 186 between the crossover tool mandrel 172 and the cup sleeve 174 provides a fluid pathway between the upper 182 and lower 184 diversion ports. A closing sleeve 190 on the cup sleeve 174 facilitates selective blocking of the lower diversion ports 184. In the position shown in FIGS. 1B and 1B1, ports 192 in the closing sleeve 190 are aligned with the lower diversion ports 184, and thus the closing sleeve 190 is in an open position. The closing sleeve 190 is temporarily held in the open position by one or more fastener 194, such as a latch, locking dog, collet, C-ring, snap ring, shear ring, shear screw, shear pin, or the like. A port 196 through the crossover tool mandrel 172 and a port 198 through the cup sleeve 174 provide fluid communication between the throughbore 104 of the deployment assembly 100 and a pressure chamber 200 between the cup sleeve 174 and the closing sleeve 190.

Figure 1D:
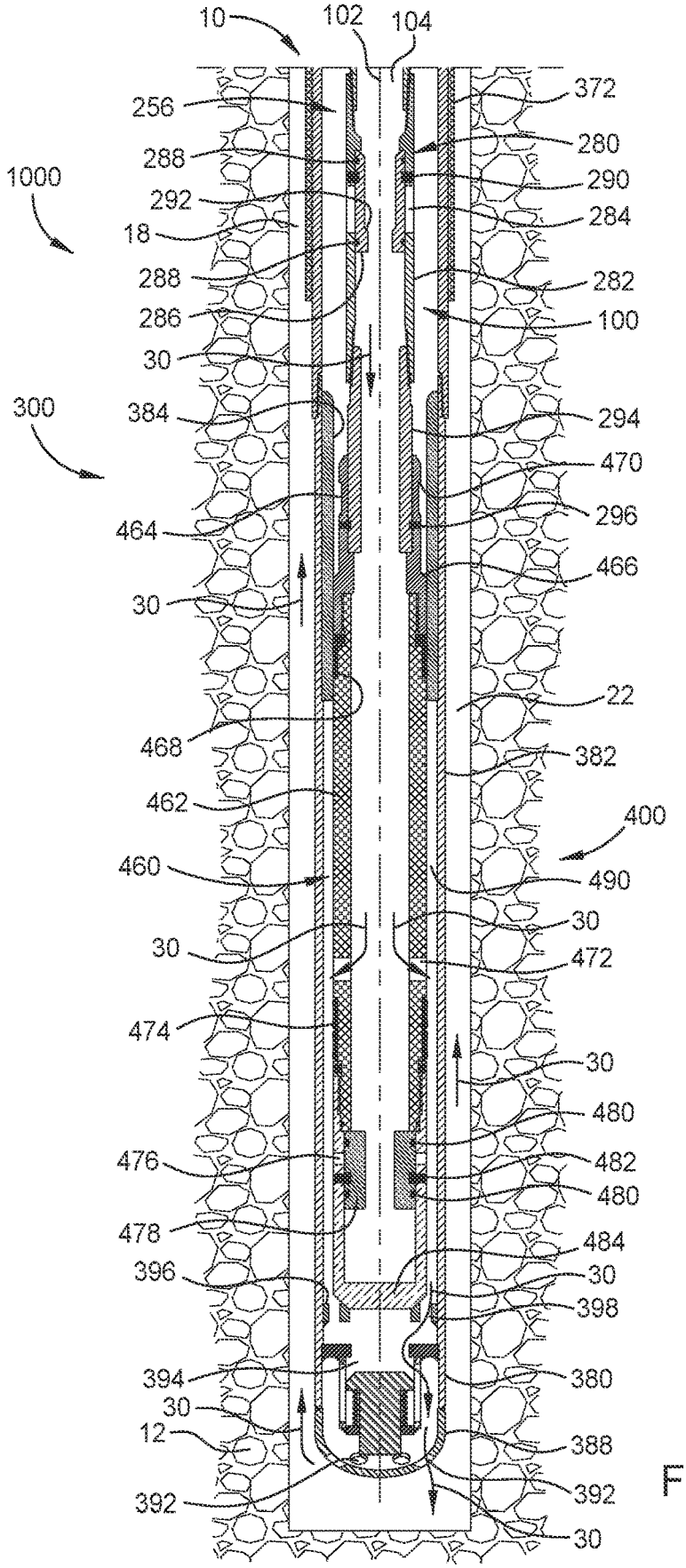
Figure 1E:
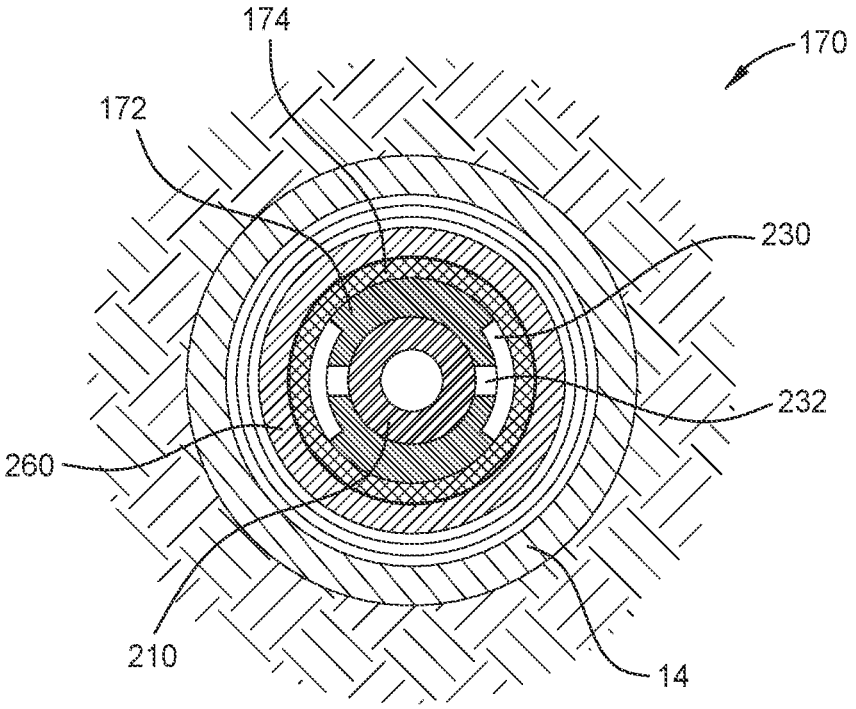
FIGS. 1E-1H provide lateral cross-sectional views of selected portions of the gravel pack system of FIGS. 1A-1D.

Gravel ports 202 in the crossover tool mandrel 172 and gravel ports 180 in the cup sleeve 174, provide fluid communication between the throughbore 104 of the deployment assembly 100 and the lower annular zone 22. Each gravel port 202 in the crossover tool mandrel 172 is encircled by a gravel port seal 204, such as an o-ring. FIG. 1L is a side view of the crossover tool mandrel 172 showing a gravel port 202 surrounded by a corresponding gravel port seal 204. Continuing with FIG. 1B1, an opening sleeve 210 within the crossover tool mandrel 172 blocks fluid access between the throughbore 104 of the deployment assembly 100 and the gravel ports 180, 202, but is movable to open fluid communication to the gravel ports 180, 202. The opening sleeve 210 is temporarily held in the blocking position by one or more fastener 212, such as a latch, locking dog, collet, C-ring, snap ring, shear ring, shear screw, shear pin, or the like.

Figure 1F:
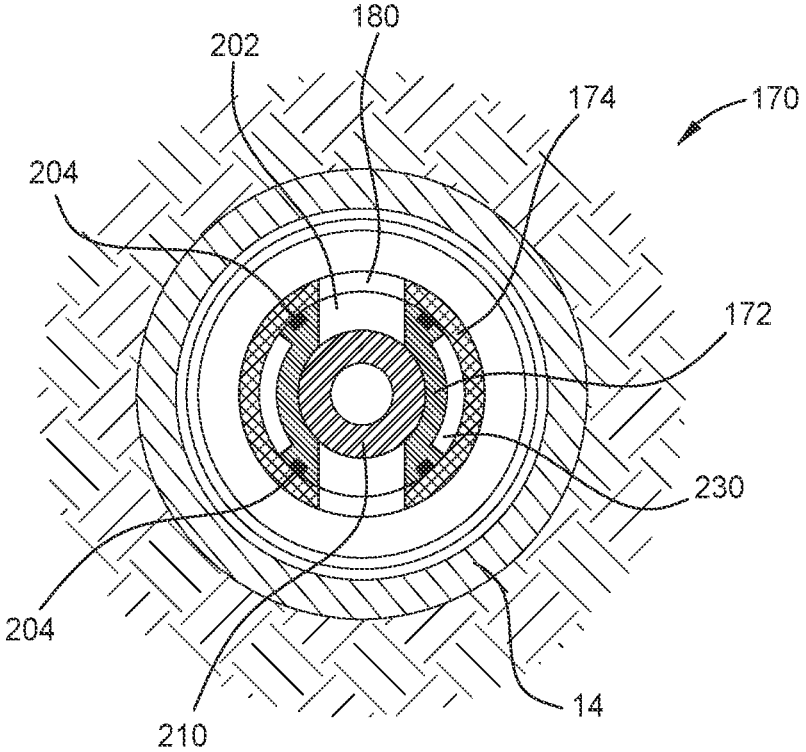
Figure 1G:
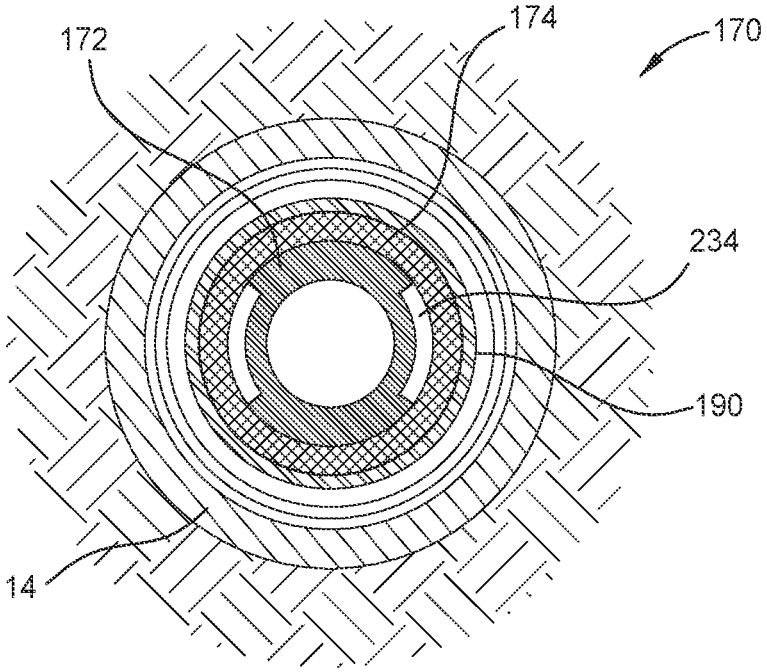
Figure 1H:
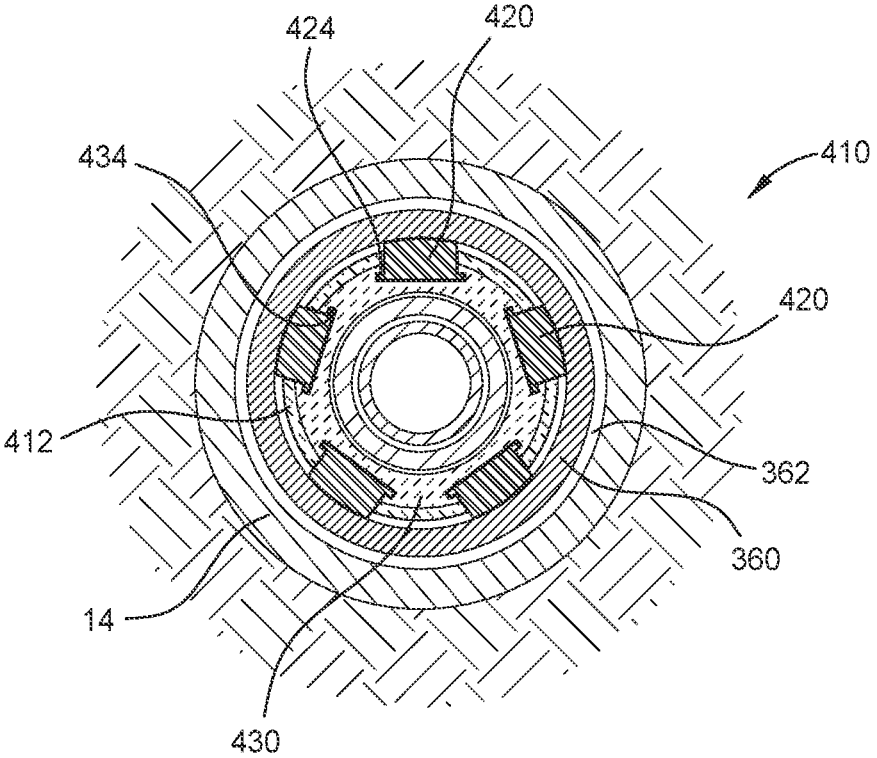
Figure 1I:
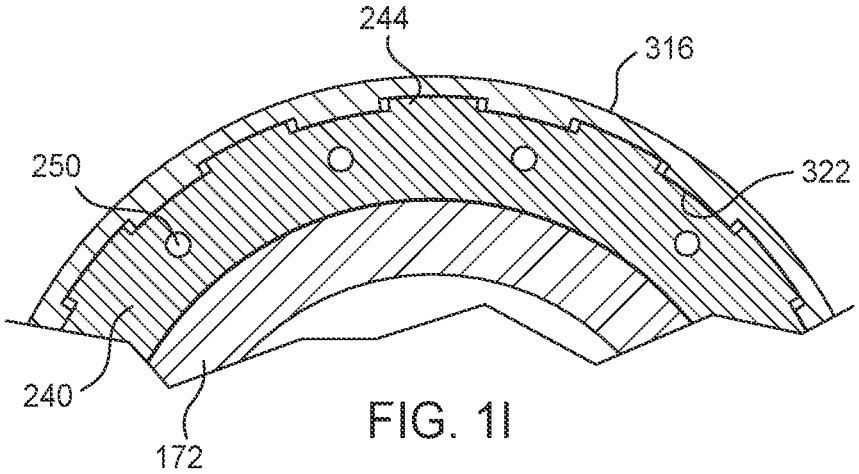
FIGS. 1I and 1J provide partial lateral cross-sectional views of selected portions of the gravel pack system of FIGS. 1A-1D.
Figure 1J:
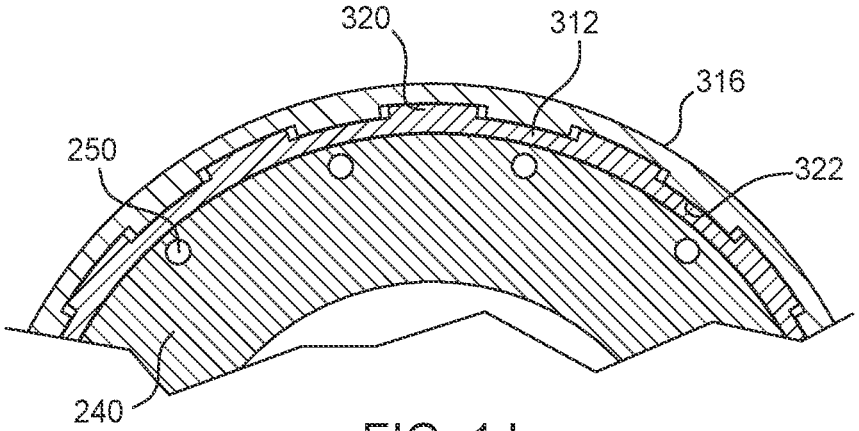

FIG. 1F is a lateral cross section through the crossover tool 170. Bypass channels 230 between the crossover tool mandrel 172 and the cup sleeve 174 provide a fluid path that is isolated from the gravel ports 202, 180 by the gravel port seals 204. FIG. 1E is a lateral cross section through the crossover tool 170 at a location below the lateral cross section of FIG. 1F. As shown in FIG. 1E, lower bypass ports 232 in the crossover tool mandrel 172 provide fluid access to the bypass channels 230. FIG. 1G is a lateral cross section through the crossover tool 170 at a location above the lateral cross section of FIG. 1F. Upper bypass ports 234 provide fluid access between the bypass channels 230 (shown in FIG. 1F) and the diversion channel 186 (shown in FIGS. 1B and 1B1) between the crossover tool mandrel 172 and the cup sleeve 174.

Continuing with FIGS. 1B and 1B1, the opening sleeve 210 includes a crossover port 214. With the opening sleeve 210 in the position shown in FIGS. 1B and 1B1, seal 216, such as an o-ring, prevents fluid communication between the crossover port 214 and the gravel ports 202. Additionally, seal 218, such as an o-ring, prevents fluid communication between the crossover port 214 and the lower bypass ports 232. Seal 220, such as an o-ring, prevents fluid communication between the throughbore 104 of the deployment assembly 100 and the lower bypass ports 232.

The opening sleeve 210 includes a seat 222 that is configured to receive an obturating object, such as a ball, a cone, a dart, a plug, or the like. The opening sleeve 210 also includes one or more toggle 224 above the seat 222. The toggle 224 includes a ring 226 disposed around a pin 228. A loose fit of the ring 226 around the pin 228 affords the ring 226 a limited freedom of lateral movement with respect to the pin 228. In FIG. 1B, the ring 226 is depicted as extending to a radially outward position with respect to the opening sleeve 210, and engaged in a recess 188 of the crossover tool mandrel 172.

A bonnet 260 is coupled to a lower end of the cup sleeve 174. The bonnet 260 is configured to engage a top of the liner assembly 300, as described below. Transitioning to FIG. 1B2, the crossover tool mandrel 172 of the crossover tool 170 is coupled to liner running sub 240. The liner running sub 240 includes one or more pressure relief channels 250. In some embodiments, it is contemplated that the liner running sub 240 may be formed as separate pieces that are joined together with the one or more pressure relief channels therebetween.

The liner running sub 240 includes a thread 242 and one or more outwardly projecting splines 244. The liner running sub 240 is configured such that the thread 242 and the one or more outwardly projecting splines 244 are immovable with respect to each other. In one example, the liner running sub 240 including the thread 242 and the one or more outwardly projecting splines 244 is formed as a unitary structure. In another example, the thread 242 and the one or more outwardly projecting splines 244 are formed on separate sub-components that are joined together to form the liner running sub 240.

Transitioning from FIG. 1B2 to FIGS. 1C and 1C1, an inner string 256 including one or more tubulars extends from the liner running sub 240. As illustrated, the inner string 256 includes an expansion joint 270. The expansion joint 270 includes an inner mandrel 272 disposed within an outer mandrel 276. The outer mandrel 276 is coupled to the liner running sub 240; the inner mandrel 272 is coupled to a tubular of the inner string 256. The inner mandrel 272 is configured to be movable telescopically with respect to the outer mandrel 276 to facilitate juxtaposition of the deployment assembly 100 with the liner assembly 300 during make-up of the liner assembly 300 to the deployment assembly 100. In some embodiments, it is contemplated that the expansion joint 270 may be omitted.

Transitioning to FIG. 1D, the inner string 256 includes a gravel pack valve 280. The gravel pack valve 280 includes a housing 282. Ports 284 are disposed in the housing 282. In the housing 282, a sleeve 286 with seals 288 blocks fluid communication through the ports 284, but is movable in order to open fluid communication through the ports 284. The sleeve 286 is temporarily held in the blocking position by one or more fastener 290, such as a latch, locking dog, collet, C-ring, snap ring, shear ring, shear screw, shear pin, or the like. The sleeve 286 includes a seat 292 that is configured to receive an obturating object, such as a ball, a cone, a dart, a plug, or the like.

The gravel pack valve 280 is coupled to an isolation packer 460 of the isolation assembly 400, described below. A tail pipe 294 extends from the gravel pack valve 280 and into engagement with a fishing neck 464 of the isolation packer 460. The tail pipe 294 is coupled to the fishing neck 464 by one or more fastener 296, such as a latch, locking dog, collet, C-ring, snap ring, shear ring, shear screw, shear pin, or the like.

As shown in FIGS. 1A-1D, the throughbore 104 of the deployment assembly 100 extends from the top connection 106 through the setting tool mandrel 112, the crossover tool mandrel 172, the liner running sub 240, the expansion joint 270 (if present), the inner string 256 including the gravel pack valve 280, and the tail pipe 294.

Liner Assembly

As shown in FIGS. 1B and 1B2, when the deployment assembly 100 is coupled to the liner assembly 300 in order to run the liner 370 into the wellbore 10, the liner running sub 240 is coupled to a packer 310 of the liner assembly 300. The packer 310 includes a packer mandrel 312. The thread 242 of the liner running sub 240 is engaged with a corresponding thread 314 of the packer mandrel 312, thereby coupling the packer mandrel 312 of the packer 310 to the deployment assembly 100. An actuation sleeve 316 is disposed about the packer mandrel 312, and extends upwardly beyond an upper end 318 of the packer mandrel 312. With reference to FIGS. 1B2, 1I, and 1J, the packer mandrel 312 includes one or more outwardly projecting splines 320 disposed between corresponding inwardly projecting splines 322 of the actuation sleeve 316. The one or more outwardly projecting splines 244 of the liner running sub 240 are disposed at the upper end 318 of the packer mandrel 312, and are aligned with the one or more outwardly projecting splines 320 of the packer mandrel 312. The one or more outwardly projecting splines 244 of the liner running sub 240 are disposed between the inwardly projecting splines 322 of the actuation sleeve 316, and hence the liner running sub 240 and the packer mandrel 312 are rotationally locked together by the inwardly projecting splines 322 of the actuation sleeve 316.

As best shown in FIG. 1B2, a packer element 324 is disposed about the packer mandrel 312, and includes a body of deformable material, such as an elastomer. The packer element 324 is shown bounded by upper 326 and lower 328 backup rings, such as metal rings. In some embodiments, it is contemplated that the backup rings 326, 328 may be omitted. The packer element 324 is movable between radially retracted and radially extended positions.

A sand barrier 330 is disposed adjacent the packer element 324. The sand barrier 330 is movable between radially retracted and radially extended positions. The sand barrier 330 includes a deformable ring 332 located between upper 334 and lower 338 end caps. The deformable ring 332 is made from a robust yet malleable material, such as a metal, such as steel, and is bowed outwardly between the upper 334 and lower 338 end caps. A shoulder 340 on the lower end cap 338 interacts with a lower shoulder 344 on the packer mandrel 312 to prevent downward movement of the lower end cap 338. The upper end cap 334 is disposed adjacent the packer element 324, such as adjacent the lower backup ring 328. As illustrated, a shoulder 336 on the upper end cap 334 is separated from an upper shoulder 342 on the packer mandrel 312.

As illustrated, the sand barrier 330 is shown in the radially retracted position. In operation, axial compression is applied to the sand barrier 330 in order to move the sand barrier 330 to the radially extended position. The applied axial compression causes the upper end cap 334 to move towards the lower end cap 338. Because the lower end cap 338 is prevented from moving downward, the deformable ring 332 becomes distorted radially outwardly. Outward distortion of the deformable ring 332 is limited by contact between the deformable ring 332 and the surrounding casing 14, and/or by engagement between the shoulder 336 on the upper end cap 334 and the upper shoulder 342 on the packer mandrel 312.

In some embodiments, it is contemplated that the sand barrier 330 may be omitted.

Figure 1K:
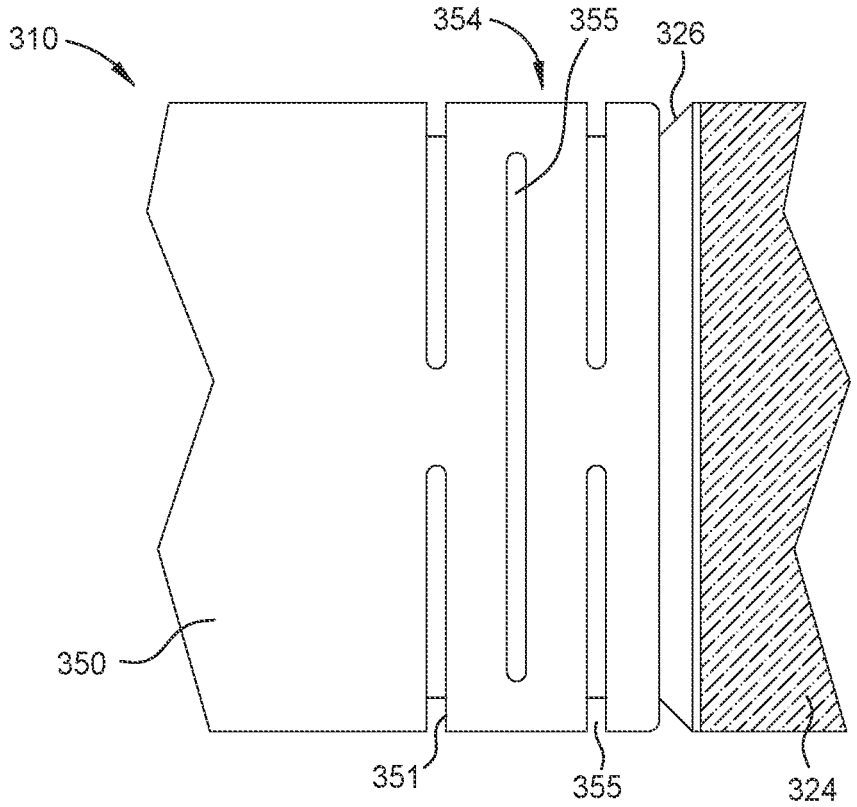
FIG. 1K is a side view of a component of the gravel pack system of FIGS. 1A-1D.
Figure 1L:
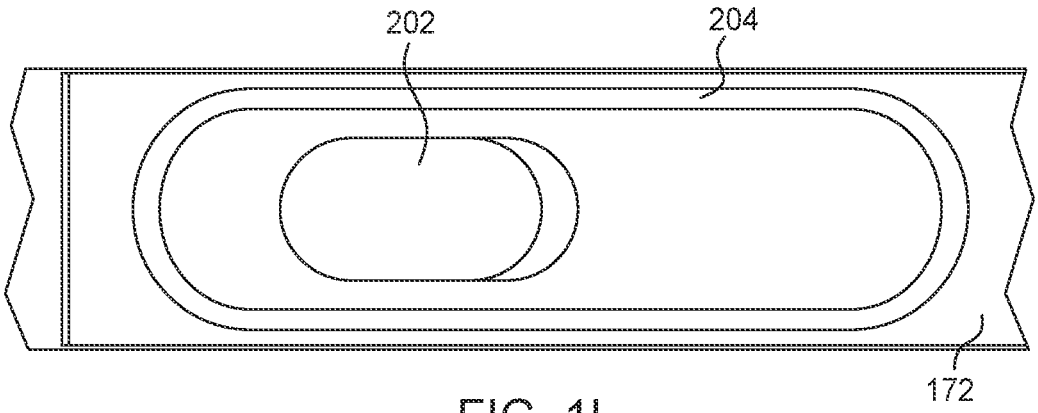
FIG. 1L is a side view of another component of the gravel pack system of FIGS. 1A-1D.

A packer setting sleeve 350 is disposed above the packer element 324. The packer setting sleeve 350 includes a spring section 354 disposed adjacent the packer element 324, such as adjacent the upper backup ring 326. FIG. 1K is a side view of the spring section 354. The spring section 354 includes overlapping slots 355 formed in a wall 351 of the packer setting sleeve 350. Each slot 355 extends partially around the packer setting sleeve 350. In some embodiments, it is contemplated that each slot 355 may extend circumferentially around the packer setting sleeve 350. Additionally, or alternatively, each slot 355 may extend helically around the packer setting sleeve 350. In some embodiments, it is contemplated that each slot 355 may extend completely through the wall 351 of the packer setting sleeve 350. Additionally, or alternatively, each slot 355 may extend partially through the wall 351 of the packer setting sleeve 350.

As best shown in FIG. 1B3, the packer setting sleeve 350 is engaged with a lock ring 356. The lock ring 356 includes ratchet teeth 358 that are configured to engage with corresponding ratchet teeth 348 on the packer mandrel 312. As shown in FIG. 1B2, the packer setting sleeve 350 is coupled to the actuation sleeve 316 by one or more fastener 352, such as a latch, locking dog, collet, C-ring, snap ring, shear ring, shear screw, shear pin, or the like.

Returning to FIG. 1B1, the bonnet 260 of the deployment assembly 100 is disposed against the actuation sleeve 316, and prevents sand and debris from entering the actuation sleeve 316. A seal 262, such as an o-ring, prevents fluid from passing between the bonnet 260 and the actuation sleeve 316.

Returning to FIGS. 1C and 1C1, the packer 310 is coupled to a locator sub 360. When used, as shown, to house the isolator body 410, the locator sub 360 may be considered to be part of the isolation assembly 400 and part of the liner assembly 300. The locator sub 360 includes an internal recess 362 configured to receive one or more locking dogs 420 of the isolator body 410 of the isolation assembly 400, described below. In embodiments in which the isolation assembly 400 is omitted, the locator sub 360 may be omitted. The locator sub 360 is coupled to liner 370 of the liner assembly 300. The liner 370 includes sand control screen 372. The sand control screen 372 includes a tubular configured to allow passage of fluid through a wall thereof, while inhibiting the passage of sand or other particulate matter. For example, the sand control screen 372 may include a slotted liner and/or a woven mesh filter and/or wire wrapping. It is contemplated that the liner 370 may include a plurality of tubulars, such as a plurality of sand control screens 372, connected together.

Transitioning to FIG. 1D, the liner 370 including sand control screen 372 is coupled to a circulating shoe 380 of the liner assembly 300. The circulating shoe 380 includes a tubular body 382 with an inner seal bore 384 at an upper end and a nose 388 at a lower end. Flow ports 392 are disposed in the nose 388. The circulating shoe 380 includes a one-way valve 394 at the lower end. The one-way valve 394 is configured to permit fluid flow from the tubular body 382 out of the flow ports 392, and inhibit fluid flow through the flow ports 392 into the tubular body 382. An inner shoulder 396 is disposed above the one-way valve 394. The inner shoulder 396 includes a fluid passage 398. The isolation packer 460 (described in more detail below) is disposed on the inner shoulder 396.

Isolation Assembly

FIGS. 1C and 1C1 show the isolator body 410 secured within the locator sub 360. The isolator body 410 includes an isolator mandrel 412 with one or more seal elements 414 disposed therearound. The one or more seal elements 414 contact an inner surface 364 of the locator sub 360, and provide a seal between the locator sub 360 and the isolator body 410. One or more locking dogs 420 protrude through apertures 416 in the isolator mandrel 412, and engage with the internal recess 362 of the locator sub 360.

A sleeve 430 within the isolator mandrel 412 provides radial support to each locking dog 420. The sleeve 430 includes a slope 432 that interfaces with a corresponding slope 422 of each locking dog 420. As shown in the lateral cross-sectional view of FIG. 1H, each locking dog 420 includes a tab 424 positioned in a corresponding slot 434 of the sleeve 430. Interaction between the slope 422 and the slope 432, and between tab 424 and slot 434, facilitates radial extension and retraction of each locking dog 420 through each corresponding aperture 416 upon axial movement of the sleeve 430 with respect to the isolator mandrel 412. Returning to FIGS. 1C and 1C1, the sleeve 430 is at least temporarily retained in the position shown in the Figures by one or more fastener 436, such as a latch, locking dog, collet, C-ring, snap ring, shear ring, shear screw, shear pin, or the like. Upon defeat (such as by unlatching, unlocking, flexing, shearing, or the like) of the fastener 436, upward movement of the sleeve 430 is limited by interaction between an end 438 of the sleeve 430 and a shoulder 418 of the isolator mandrel 412.

A fastener 442 (such as a latch, locking dog, collet, C-ring, snap ring, shear ring, shear screw, shear pin, or the like) is disposed partially in a recess 440 within the isolator mandrel 412 for eventual securement of the isolation packer 460. Below the recess 440 is a downward-facing shoulder 444 and a seal bore 446.

The isolation packer 460 is illustrated in FIG. 1D. The isolation packer 460 includes a packer body 462 and a fishing neck 464. As described above, when installed, as shown, in the circulating shoe 380, the fishing neck 464 is coupled to the tail pipe 294 by fastener(s) 296. The fishing neck 464 includes an external downward-facing shoulder 470. An upward-facing shoulder 466 is located below the fishing neck 464. Upper seal element 468 is disposed around the packer body 462 and makes sealing contact with the inner seal bore 384 of the circulating shoe 380. One or more circulation ports 472 facilitate fluid communication between the interior and exterior of the packer body 462. Lower seal element 474 is disposed around the packer body 462. As shown in the Figure, when the isolation packer 460 is installed in the circulating shoe 380, the lower seal element 474 is not in sealing contact with the circulating shoe 380.

One or more dump ports 476 below the lower seal element 474 facilitate fluid communication between the interior and exterior of the packer body 462. A sleeve 478 within the packer body 462 at least temporarily obscures the one or more dump ports 476. The sleeve 478, together with seals 480, inhibit fluid passage through the one or more dump ports 476. The sleeve 478 is temporarily held in the illustrated blocking position by one or more fastener 482, such as a latch, locking dog, collet, C-ring, snap ring, shear ring, shear screw, shear pin, or the like. A nose 484 at the bottom of the isolation packer 460 blocks fluid communication between the interior and exterior of the packer body 462.

Operations

While running the gravel pack system 1000 into the wellbore 10, the weight of the liner assembly 300 is carried through the engaged threads 314, 242 of the packer 310 and the liner running sub 240, respectively. In embodiments in which the deployment assembly 100 includes the expansion joint 270, the weight of the inner mandrel 272 of the expansion joint 270 and the components (such as the inner string 256, gravel pack valve 280, and—if present—isolation packer 460) suspended below the inner mandrel 272 is carried on the inner shoulder 396 of the circulating shoe 380 of the liner assembly 300, and hence is also carried through the engaged threads 314, 242 of the packer 310 and the liner running sub 240, respectively.

While running the gravel pack system 1000 into the wellbore 10, rotation of the deployment assembly 100 about the longitudinal axis 102, such as by rotating work string 16, is transferred to the liner assembly 300 through engagement between the one or more outwardly projecting splines 244 of the liner running sub 240 with the inwardly projecting splines 322 of the actuation sleeve 316, and in turn through engagement between the inwardly projecting splines 322 of the actuation sleeve 316 with the one or more outwardly projecting splines 320 of the packer mandrel 312. While running the gravel pack system 1000 into the wellbore 10, it is contemplated that the liner assembly 300 may thus be rotated in order to facilitate passage of the liner assembly 300 in the wellbore 10.

Fluid, such as a drilling fluid or a brine, may be circulated through the gravel pack system 1000 while running the gravel pack system 1000 into the wellbore 10. Additionally, after positioning the liner assembly 300 adjacent the geological formation 12 in the wellbore 10, an operation, such as a gravel packing operation, commences by circulating a fluid through the gravel pack system 1000. The fluid may include a drilling fluid. Additionally, or alternatively, the fluid may include a brine.

As shown in FIGS. 1A, 1B, 1C, and 1D, the fluid is circulated in a path indicated by arrows 30. The fluid is circulated through the work string 16 and the throughbore 104 of the deployment assembly 100. The fluid passes through the tail pipe 294 extending from the gravel pack valve 280 and into the isolation packer 460. The fluid then passes through the circulation port(s) 472 of the isolation packer 460 and into the annular space 490 between the isolation packer 460 and the tubular body 382 of the circulating shoe 380. The upper seal element 468 engaged with the inner seal bore 384 of the tubular body 382 prevents the fluid from entering the liner 370 from the circulating shoe 380. Instead, the fluid passes via the fluid passage 398 of the inner shoulder 396 of the circulating shoe 380, the one way valve 394, and the flow ports 392 in the nose 388 into the lower annular zone 22.

The seal 262 between the bonnet 260 and the actuation sleeve 316 inhibits fluid flow within the liner assembly 300 outside of the deployment assembly 100. Hence, the fluid circulated into the lower annular zone 22 passes up through the lower annular zone 22 to the packer cups 176, 178. The packer cups 176, 178 are orientated such that a net pressure below the packer cups 176, 178 energizes the packer cups 176, 178 into sealing engagement with the casing 14. Thus, the fluid passes through the ports 192 in the closing sleeve 190, the lower diversion ports 184, the diversion channel 186, and the upper diversion ports 182 into the upper annular zone 20. The fluid then passes through the upper annular zone 20 and out of the wellbore 10.

FIGS. 2A-2G illustrate the gravel pack system 1000 during a subsequent operation. A first obturating object, such as ball 31, is conveyed through the work string 16 and the throughbore 104 of the deployment assembly 100, and lands on the seat 292 of the sleeve 286 in the gravel pack valve 280. Pressure is applied via the fluid in the work string 16 and the throughbore 104 of the deployment assembly 100 to the ball 31, causing the defeat (such as by unlatching, unlocking, flexing, shearing, or the like) of the fastener 290. The sleeve 286 and ball 31 move downward, opening fluid communication through the ports 284.

Then a second obturating object, such as ball 32, is conveyed through the work string 16 and the throughbore 104 of the deployment assembly 100, and lands on the seat 222 of the opening sleeve 210 of the crossover tool 170. Pressure is applied via the fluid in the work string 16 and the throughbore 104 of the deployment assembly 100 to the ball 32. The pressure is communicated through the ports 196 in the crossover tool mandrel 172, through the ports 198 in the cup sleeve 174, and into the pressure chamber 200 between the cup sleeve 174 and the closing sleeve 190.

When the applied pressure reaches a first threshold value, the fastener 194 is defeated (such as by unlatching, unlocking, flexing, shearing, or the like), and the pressure in the pressure chamber 200 causes the closing sleeve 190 to move to block fluid communication between the lower annular zone 22 and the lower diversion port 184. The pressure applied via the fluid in the work string 16 and the throughbore 104 of the deployment assembly 100 to the ball 32 is then increased to a second threshold value, at which the fastener 212 is defeated (such as by unlatching, unlocking, flexing, shearing, or the like). The opening sleeve 210 and ball 32 move downward, opening fluid communication between the throughbore 104 of the deployment assembly 100 and the lower annular zone 22 through the gravel ports 202 in the crossover tool mandrel 172 and the gravel ports 180 in the cup sleeve 174. With the opening sleeve 210 in the position shown in FIG. 2B, fluid communication is opened between the throughbore 104 of the deployment assembly 100 and the bypass channels 230 through the crossover port 214 in the opening sleeve 210 and the lower bypass ports 232 in the crossover tool mandrel 172.

Figure 2A:
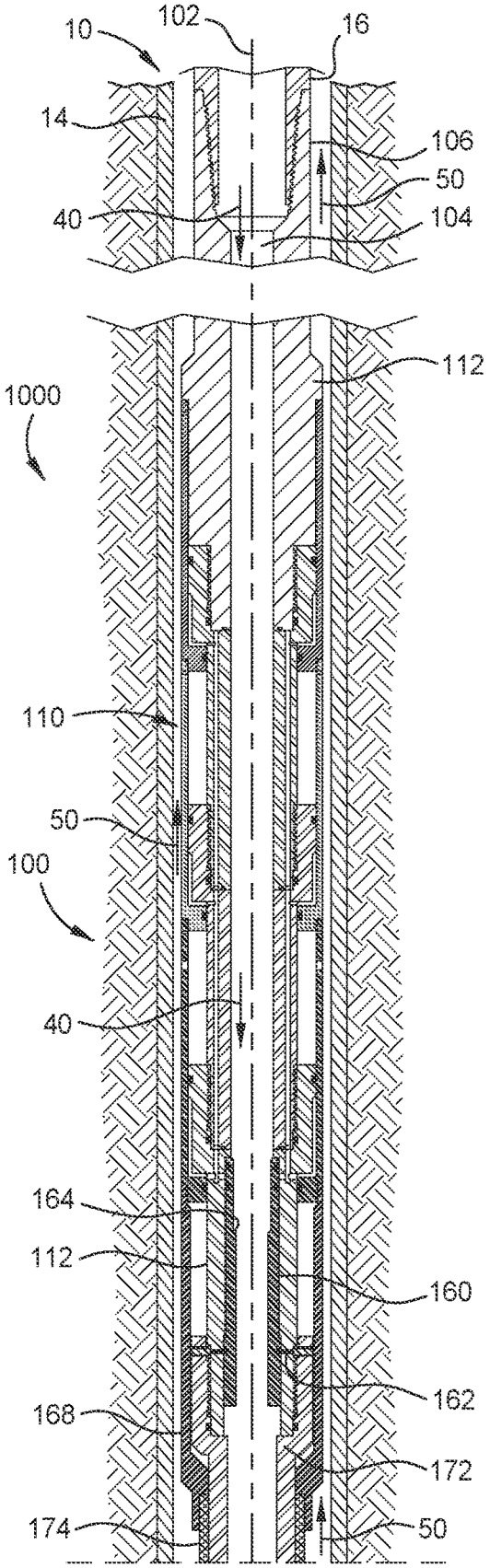
FIGS. 2A-2D provide a longitudinal cross-sectional view of the gravel pack system of FIGS. 1A-1D during an operation in the wellbore.
Figure 2B:
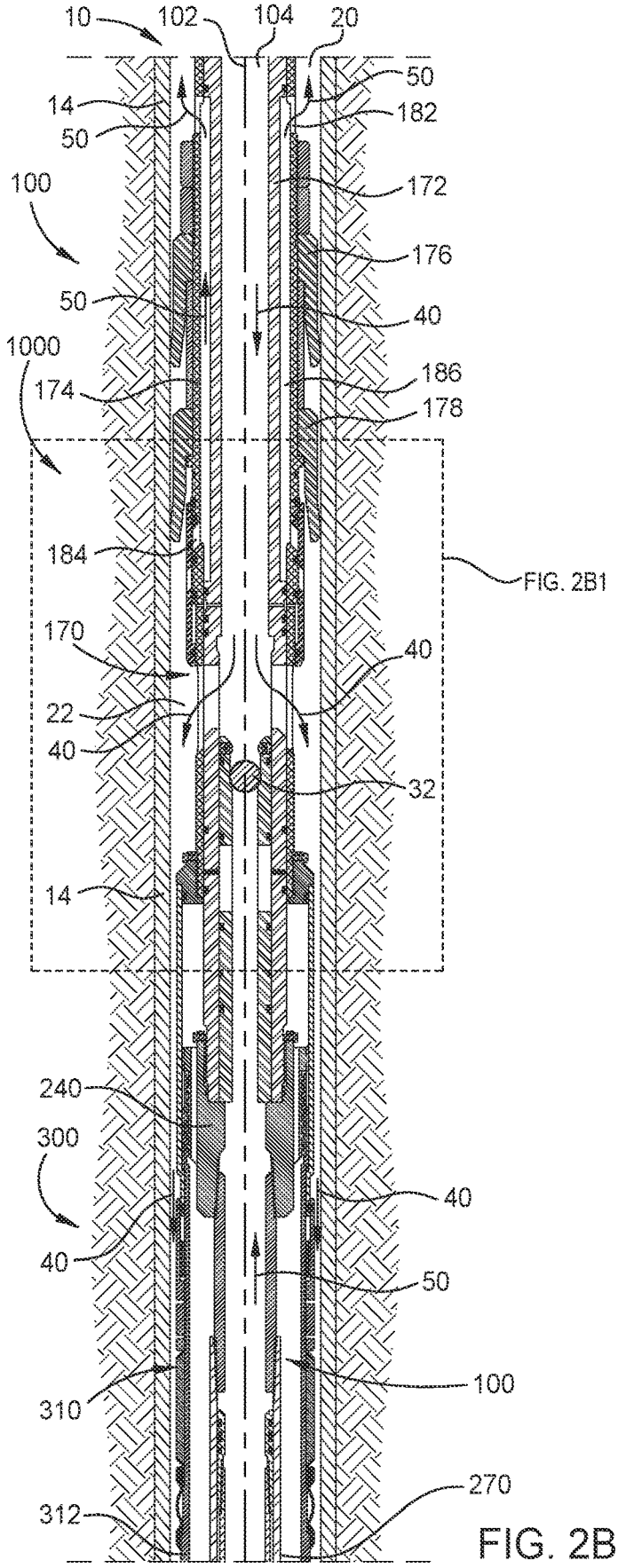
Figure 2C:
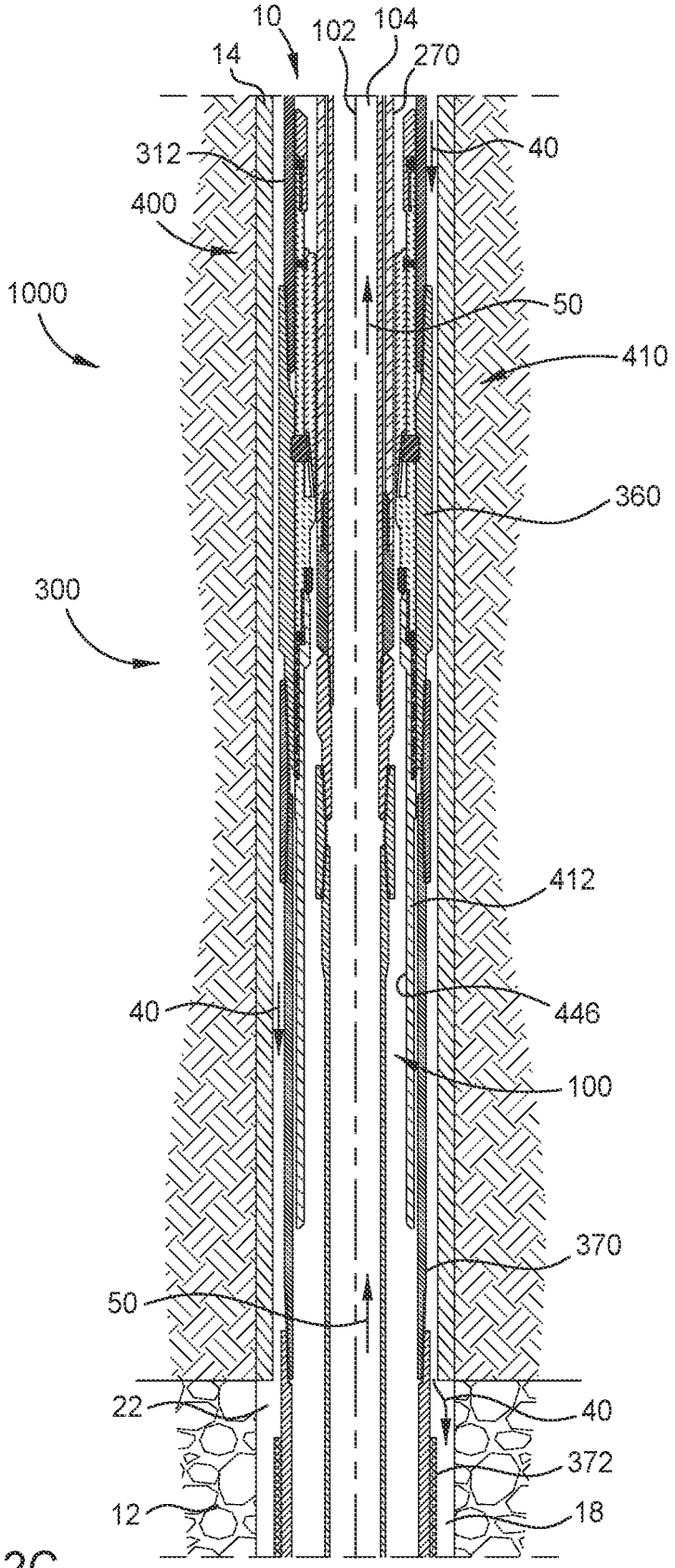
Figure 2D:
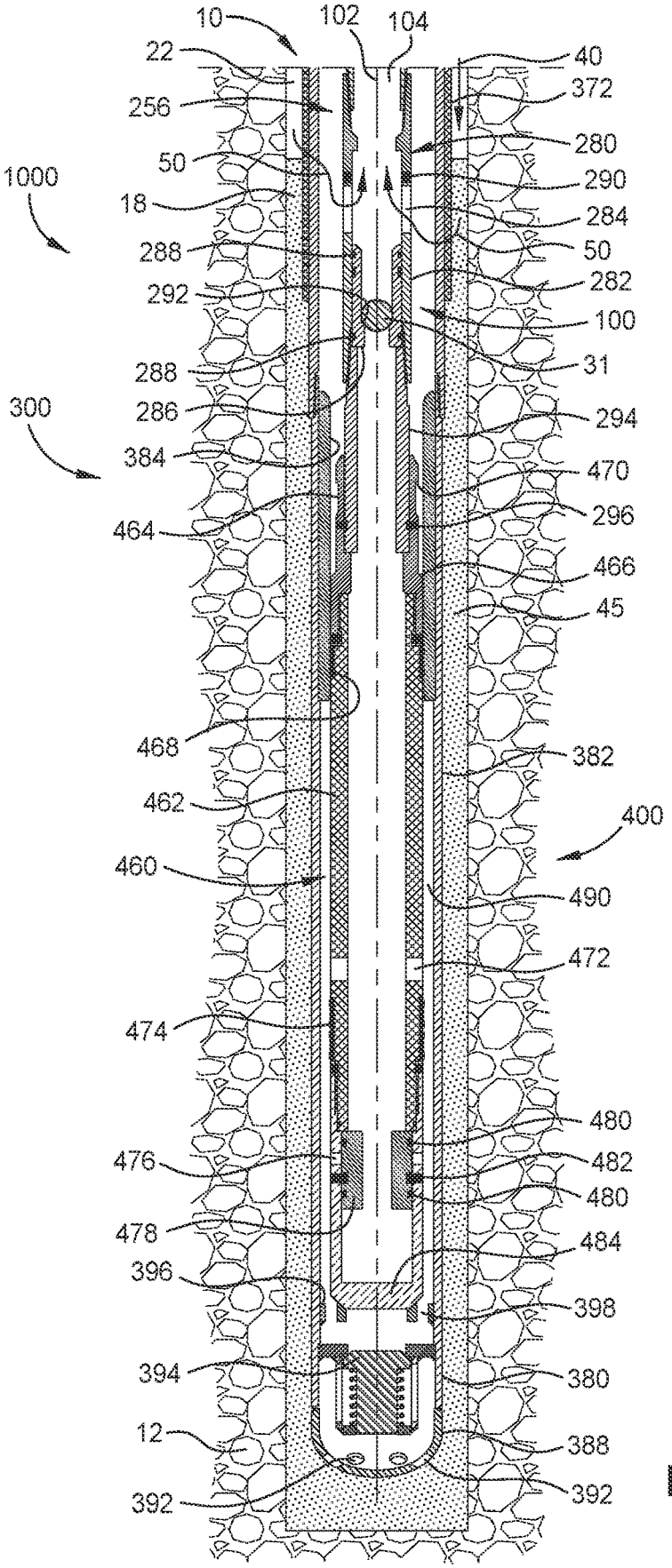
Figure 2E:
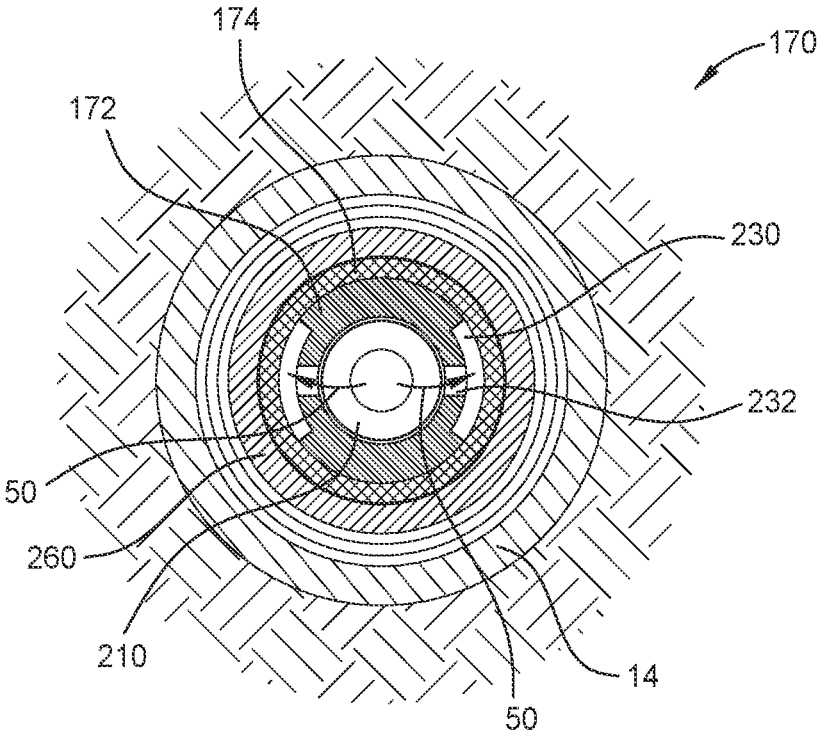
FIGS. 2E-2G provide lateral cross-sectional views of selected portions of the gravel pack system in the configuration of FIGS. 2A-2D.
Figure 2F:
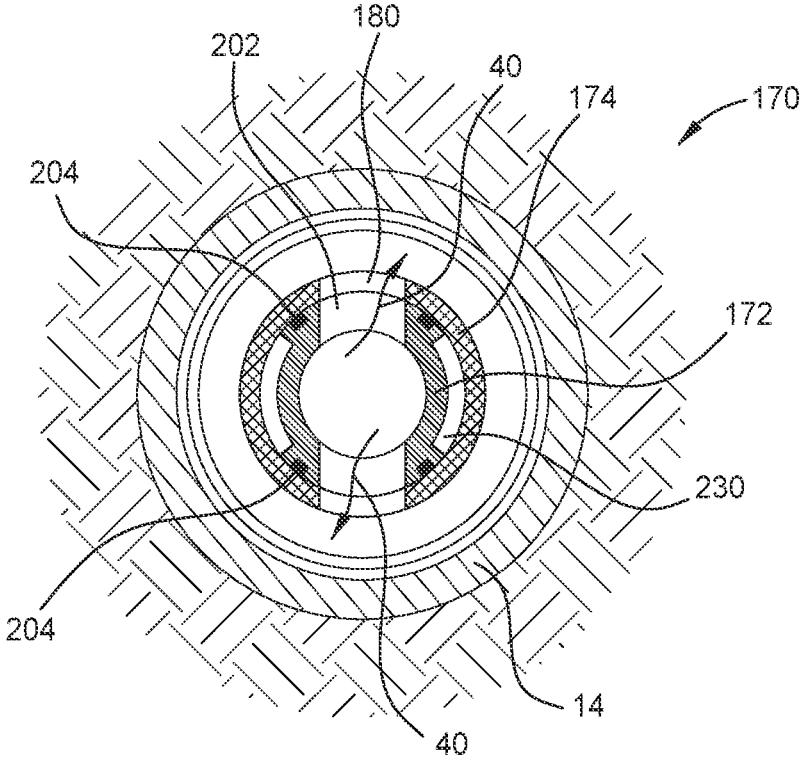
Figure 2G:
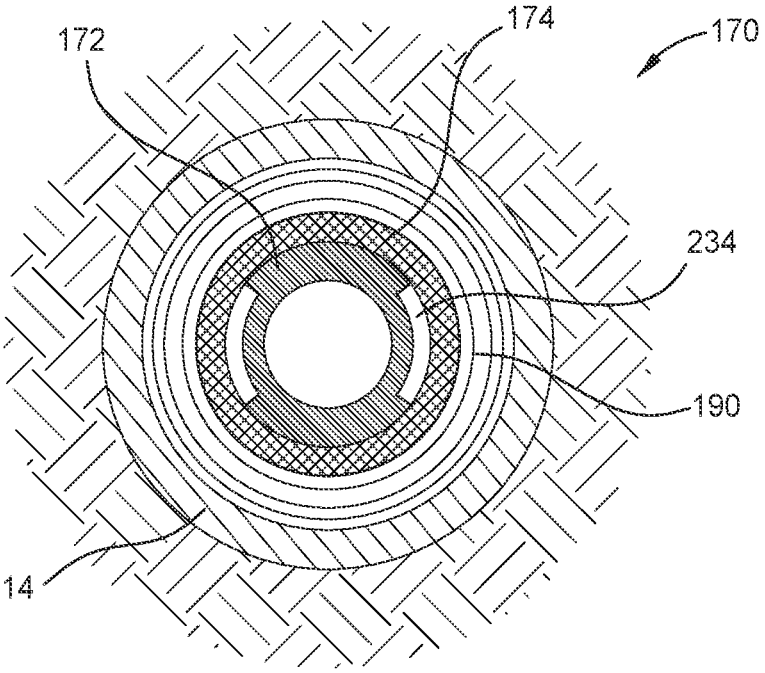

Movement of the opening sleeve 210 to the position shown in FIGS. 2B and 2B1 causes the ring 226 of the toggle 224 to exit the recess 188 of the crossover mandrel 172. The ring 226 is depicted as extending to a radially inward position with respect to the opening sleeve 210, where the ring 226 serves to inhibit upward passage of the ball 32 away from the seat 22 of the opening sleeve 210.

Then, a slurry containing particulate material, such as sand, is pumped in a path indicated by arrows 40. The slurry passes through the work string 16 and into the throughbore 104 of the deployment assembly 100. The slurry exits the deployment assembly 100 through the gravel ports 202 in the crossover tool mandrel 172 and the gravel ports 180 in the cup sleeve 174, and enters the lower annular zone 22. The slurry travels through the lower annular zone 22, and reaches a sand control screen 372 of the liner 370. The particulate material is deposited as a gravel pack 45 in the annulus 18 between the sand control screen 372 and the geological formation 12. Filtrate from the slurry continues in a path indicated by arrows 50. The filtrate passes through the sand control screen 372 into the liner 370, and then through the ports 284 of the gravel pack valve 280 into the deployment assembly 100. The filtrate continues through the inner string 256 and the expansion joint 270, if present, to the crossover tool 170.

At the crossover tool 170, the filtrate passes through the crossover port 214 in the opening sleeve 210, through the lower bypass ports 232 in the crossover tool mandrel 172, and into the bypass channels 230. The filtrate exits the bypass channels 230 through the upper bypass ports 234, and enters the diversion channel 186 between the crossover tool mandrel 172 and the cup sleeve 174. The filtrate exits the diversion channel 186 through the upper diversion port 182, and enters the upper annular zone 20. The filtrate then passes through the upper annular zone 20 and out of the wellbore 10.

As the pumping of the slurry continues, the particulate material accumulates in the annulus 18 between the liner 370 and the geological formation 12. In an example, the gravel pack 45 fills the annulus 18 around each sand control screen 372 of the liner 370. The pumping of the slurry is ceased after a predetermined quantity of particulate material has been pumped into the wellbore 10, or after a rising pumping pressure indicates completion of the gravel pack 45 around each sand control screen 372. Following ceasing the pumping of the slurry, some slurry may remain in the lower annular zone 22 above the packer 310, in the deployment assembly 100, and/or in the work string 16.

Figure 3A:
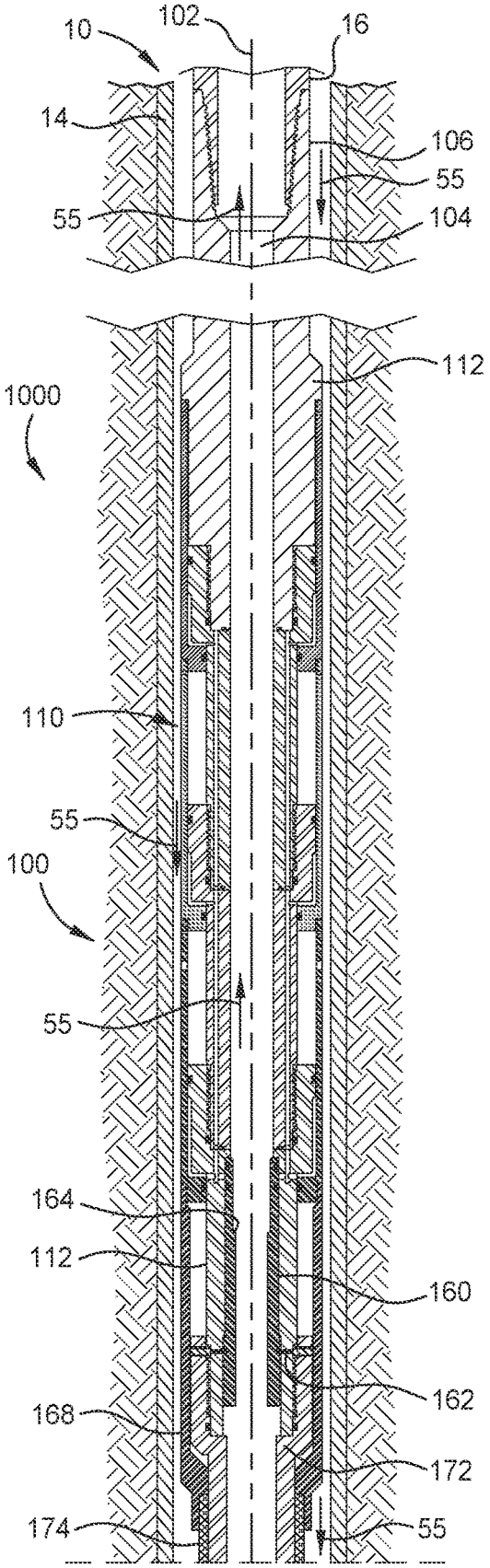
FIGS. 3A-3B provide a longitudinal cross-sectional view of a portion of the gravel pack system of FIGS. 1A-1D during a subsequent operation in the wellbore.
Figure 3B:
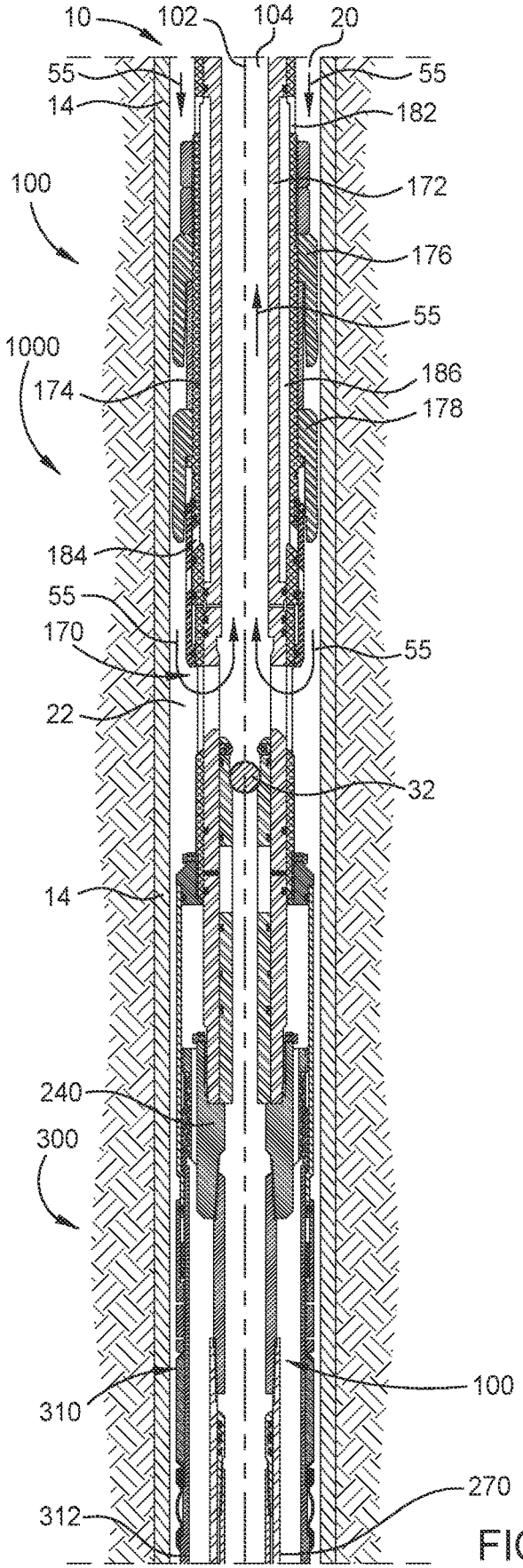

FIGS. 3A-3B illustrate a portion of the gravel pack system 1000 during a subsequent operation. Any remaining slurry is removed from the wellbore 10 by reverse circulation of a fluid, such as a brine. The fluid is pumped in a path indicated by arrows 55. The fluid is pumped into the upper annular zone, and travels down the upper annular zone to the packer cups 176, 178. The packer cups 176, 178 are orientated such that a net pressure above the packer cups 176, 178 tends to move the packer cups 176, 178 away from sealing engagement with the casing 14. Thus, the fluid passes around the packer cups 176, 178 into the lower annular zone 22. The fluid then passes through the gravel ports 180 in the cup sleeve 174 and through the gravel ports 202 in the crossover tool mandrel 172 into the crossover tool 170. The fluid then returns to surface through the crossover tool 170, the setting tool 110, and the work string 16.

Figure 4A:
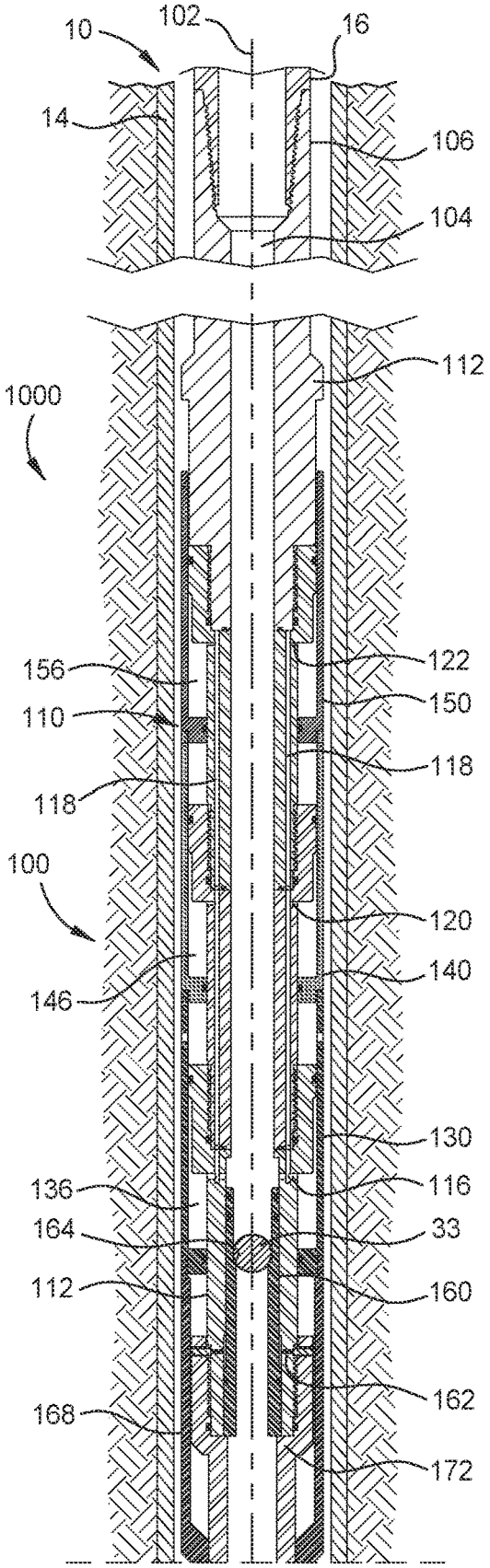
FIGS. 4A-4B provide a longitudinal cross-sectional view of a portion of the gravel pack system of FIGS. 1A-1D during a subsequent operation in the wellbore.
Figure 4B:
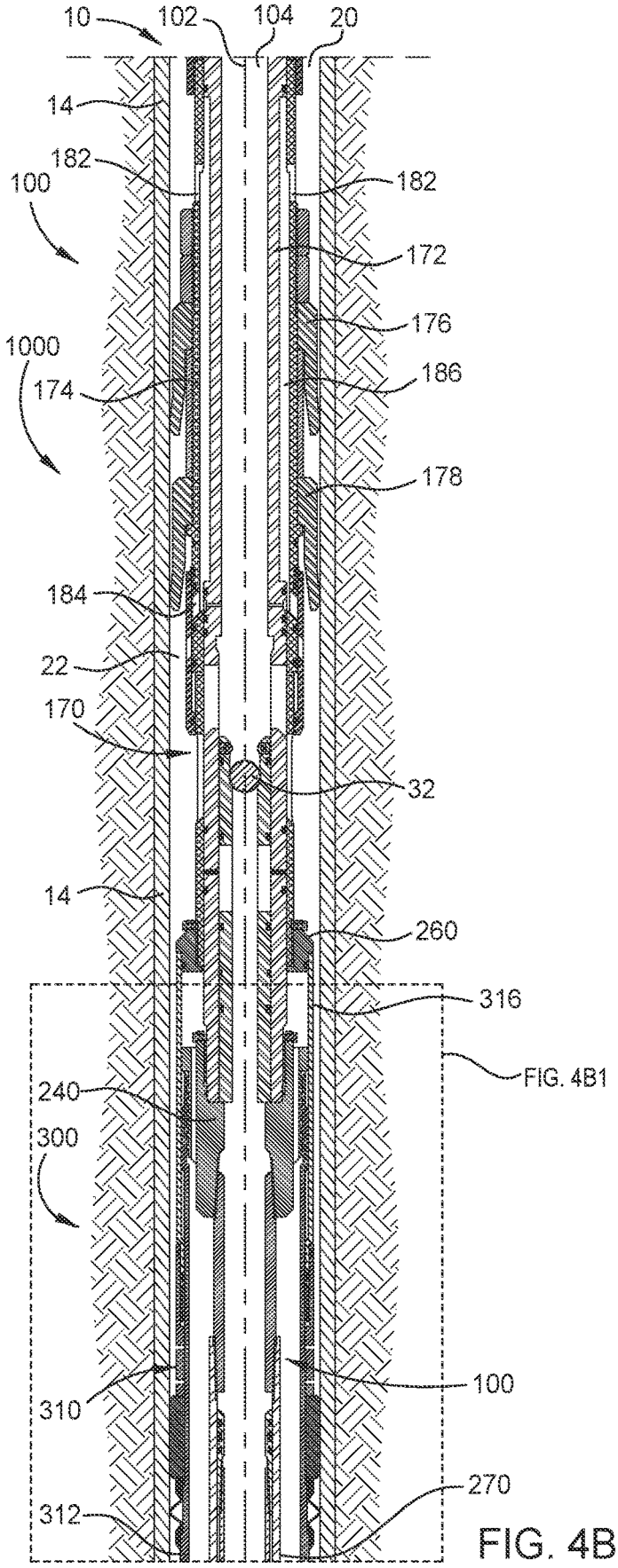

FIGS. 4A, 4B, and 4B1 illustrate a portion of the gravel pack system 1000 during a subsequent operation in which the packer element 324 becomes set. A third obturating object, such as ball 33, is conveyed through the work string 16 and the throughbore 104 of the deployment assembly 100, and lands on the seat 164 of the sleeve 160 of the setting tool 110. Pressure is applied via the fluid in the work string 16 and the throughbore 104 of the deployment assembly 100 to the ball 33, causing the defeat (such as by unlatching, unlocking, flexing, shearing, or the like) of the fastener 1B2. The sleeve 160 and ball 33 move downward, opening fluid communication to the side port 116 in the setting tool mandrel 112.

Pressure is applied via the fluid in the work string 16 and the throughbore 104 of the deployment assembly 100 to the ball 33. The pressure is communicated through the side port 116 in the setting tool mandrel 112 to the piston chamber 136. In the illustrated embodiment of the setting tool 110, the pressure is communicated also via the longitudinal bore 118 and the exit ports 120, 122 to the piston chambers 146, 156, respectively. When the applied pressure reaches a threshold value, the piston sleeves 130, 140, 150 move downward with respect to the setting tool mandrel 112.

Downward movement of the piston sleeves 130, 140, 150 causes the setting sleeve 168 of the setting tool 110 to move downward. Downward movement of the setting sleeve 168 causes downward movement of the cup sleeve 174 of the crossover tool 170 with respect to the crossover tool mandrel 172. Downward movement of the cup sleeve 174 causes downward movement of the bonnet 260. Downward movement of the bonnet 260 causes downward movement of the actuation sleeve 316 of the packer 310.

The packer mandrel 312 of the packer 310 is held axially stationary with respect to the crossover tool mandrel 172 of the crossover tool 170 by engagement of the thread 314 of the packer mandrel 312 with thread 242 of the liner running sub 240 that is coupled to the crossover tool mandrel 172. Thus, downward movement of the actuation sleeve 316 of the packer 310 is with respect to the packer mandrel 312. Downward movement of the actuation sleeve 316 causes downward movement of the packer setting sleeve 350 with respect to the packer mandrel 312.

In embodiments in which the packer 310 includes a sand barrier 330, downward movement of the packer setting sleeve 350 causes downward movement of the packer element 324 with respect to the packer mandrel 312. Downward movement of the packer element 324 causes downward movement of the upper end cap 334 of the sand barrier 330 with respect to the packer mandrel 312. Downward movement of the upper end cap 334 causes the upper end cap 334 to move towards the lower end cap 338 of the sand barrier 330, thereby distorting the deformable ring 332 of the sand barrier 330 outwardly. The deformable ring 332 is distorted outwardly until the distortion is limited by contact with the surrounding casing 14 and/or by engagement between the shoulder 336 on the upper end cap 334 and the upper shoulder 342 on the packer mandrel 312.

At this point, further downward movement of the upper end cap 334 is prevented by resistance by the deformable ring 332 and/or by engagement between the shoulder 336 on the upper end cap 334 and the upper shoulder 342 on the packer mandrel 312. Continued downward movement of the packer setting sleeve 350 causes the packer element 324 to be axially compressed against the upper end cap 334. The packer element 324 deforms outwardly, and contacts the casing 14. It is contemplated that the packer element 324 contacts the casing 14 with sufficient force to form a fluid-tight seal against the casing 14. Outward deformation of the packer element 324 results in deformation of the upper backup ring 326 and the lower backup ring 328.

In embodiments in which the packer 310 does not include a sand barrier 330, it is contemplated that the packer element 324 may be bonded to the packer mandrel 312, or may otherwise be hindered from moving axially on the packer mandrel 312, such as by a shoulder on the packer mandrel 312. Downward movement of the packer setting sleeve 350 thus causes the packer element 324 to be axially compressed. The packer element 324 deforms outwardly, and contacts the casing 14. It is contemplated that the packer element 324 contacts the casing 14 with sufficient force to form a fluid-tight seal against the casing 14. Outward deformation of the packer element 324 results in deformation of the upper backup ring 326 and the lower backup ring 328.

In embodiments in which the packer 310 includes a sand barrier 330 and in embodiments in which the packer 310 does not include a sand barrier 330, pressure is continued to be applied via the fluid in the work string 16 and the throughbore 104 of the deployment assembly 100 to the ball 33. Thus, the packer setting sleeve 350 continues to apply an axial compression force to the packer element 324. When the packer element 324 has become set, the packer element resists further axial compression.

At this point, the spring section 354 of the packer setting sleeve 350 may deform. Thereafter, the spring section 354 resists further deformation, and further downward movement of the actuation sleeve 316 results in the defeat (such as by unlatching, unlocking, flexing, shearing, or the like) of the fastener 352 that couples the packer setting sleeve 350 the actuation sleeve 316. It is contemplated that the defeat of the fastener 352 causes a shock wave to travel to the surface via the work string 16, thereby providing an indication that the packer setting has been completed. In some embodiments, it is contemplated that either the fastener 352 may not be defeated, or the defeat of the fastener 352 may not cause a shock wave to travel to the surface via the work string 16. In such embodiments, the applied pressure may be maintained at a desired level for a desired period of time until proceeding with subsequent operations.

Thereafter, the applied pressure is relieved. When the pressure is relieved, the packer element 324 remains set. Although the packer element 324 applies an upward axial force to the packer setting sleeve 350, the packer setting sleeve 350 does not move upwards with respect to the packer mandrel 312 because of engagement of the ratchet teeth 358 of the lock ring 356 of the packer setting sleeve 350 with the ratchet teeth 348 of the packer mandrel 312. The set packer element 324 holds the liner assembly 300 axially and rotationally stationary in the wellbore 10.

During the packer setting operation, downward movement of the actuation sleeve 316 with respect to the packer mandrel 312 causes the inwardly projecting splines 322 of the actuation sleeve 316 to become disengaged from the one or more outwardly projecting splines 244 of the liner running sub 240. Hence, the liner running sub 240 is no longer rotationally tied to the packer mandrel 312.

In a further operation, the work string 16 and the deployment assembly 100 are rotated about the longitudinal axis 102. The thread 242 of the liner running sub 240 becomes disengaged from the thread 314 of the packer mandrel 312, thereby releasing the deployment assembly 100 from the liner assembly 300. Rotation of the work string 16 and the deployment assembly 100 about the longitudinal axis 102 may be clockwise or anticlockwise, depending upon the orientation of the threads 242 and 314.

Figure 5B:
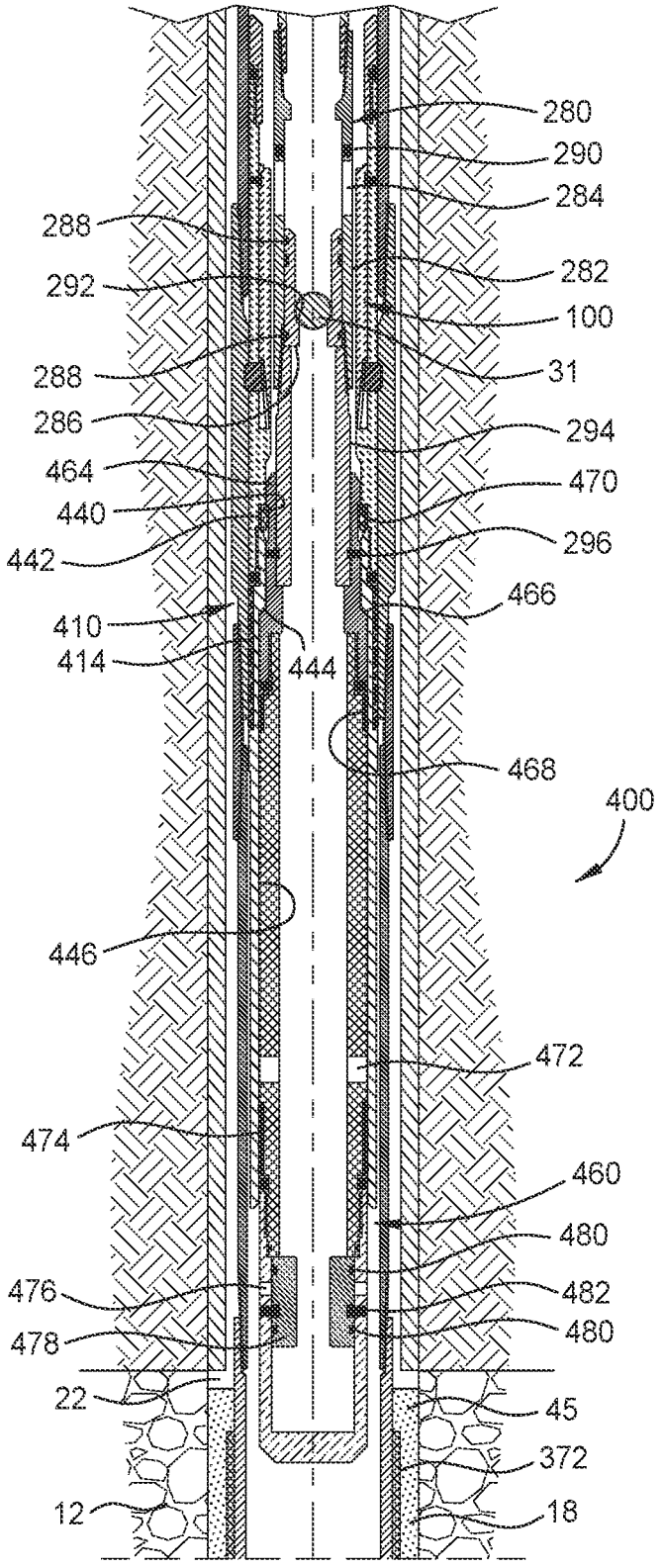

FIGS. 5A-5B illustrate portions of the gravel pack system 1000 during a subsequent operation after releasing the deployment assembly 100 from the liner assembly 300. The gravel pack 45 is shown as being established around each sand control screen 372 of the liner 370, although in some embodiments, the level of the gravel pack 45 in the annulus 18 may be higher or lower than as illustrated.

The operation includes manipulating the work string 16 to pull the deployment assembly 100 upwards. Initially, upward movement of the work string 16 is transmitted to the setting tool mandrel 112, the crossover tool mandrel 172, and the liner running sub 240. The piston sleeves 130, 140, 150 of the setting tool 110, the setting sleeve of the setting tool 110, the cup sleeve 174 of the crossover tool 170, and the bonnet 260 remain axially stationary.

Upward movement of the setting tool mandrel 112 with respect to the piston sleeve 130 results in the bulkhead 124 moving past fluid dump ports 166 in the piston sleeve 130. At this point, the upper annular zone 20 becomes in fluid communication with the throughbore 104 of the deployment assembly 100 via the fluid dump ports 166, the piston chamber 136, and the side port 116. Thus, during subsequent retrieval of the deployment assembly 100, fluid in the work string 16 is dumped by the force of gravity through the fluid dump ports 166 into the upper annular zone 20. The fluid is dumped in a path indicated by arrows 60, shown in FIG. 5A1, which is an enlarged view of a portion of FIG. 5A.

Upward movement of the setting tool mandrel 112, the crossover tool mandrel 172, and the liner running sub 240 brings the liner running sub 240 to bear against the bonnet 260. Further upward movement of the setting tool mandrel 112, the crossover tool mandrel 172, and the liner running sub 240 then results in upward movement of the bonnet 260, the cup sleeve 174 of the crossover tool 170, the setting sleeve of the setting tool 110, and the piston sleeves 130, 140, 150 of the setting tool 110.

In embodiments of the deployment assembly 100 that include the expansion joint 270, upward movement of the setting tool mandrel 112, the crossover tool mandrel 172, and the liner running sub 240 causes upward movement of the outer mandrel 276 of the expansion joint 270. The outer mandrel 276 moves upward relative to the inner mandrel 272 of the expansion joint 270 until a shoulder 278 of the outer mandrel 276 engages a corresponding shoulder 274 of the inner mandrel 272. Thereafter, further upward movement of the setting tool mandrel 112, the crossover tool mandrel 172, the liner running sub 240, and the outer mandrel 276 of the expansion joint 270 causes upward movement of the inner string 256 and the gravel pack valve 280.

In embodiments in which the gravel pack system 1000 includes an isolation assembly 400, upward movement of the deployment assembly 100 raises the isolation packer 460 out of the circulating shoe 380. Upward movement of the deployment assembly 100 brings the isolation packer 460 into engagement with the isolator body 410. The isolation packer 460 enters the isolator mandrel 412.

The fishing neck 464 of the isolation packer 460 interacts with the fastener 442 of the isolator body 410. For example, in embodiments in which the fastener 442 is a latch, locking dog, collet, C-ring, snap ring, or another type of flexible member, the fishing neck is raised past the fastener 442 to displace the fastener 442 radially outwards. After the external shoulder 470 has moved past the fastener 442, the fastener 442 moves back towards the position shown in FIG. 5B (for example under a biasing force, such as elastic return of the material of the fastener 442 itself).

In some embodiments, the fastener 442 is initially disposed on the isolation packer 460 instead of within the isolator body 410. In such embodiments, upward movement of the isolation packer 460 within the isolator body 410 brings the fastener 442 into engagement with the recess 440 in the isolator mandrel 412.

The external shoulder 470 on the fishing neck 464 is sized such that the external shoulder 470 can rest on the fastener 442 of the isolator body, thereby securing the isolation packer 460 to the isolator body 410. When the isolation packer 460 is secured to the isolator body 410, the weight of the isolation packer 460 is transferred to the isolator mandrel 412 via the fastener 442. When the isolation packer 460 is secured to the isolator body 410, the upper seal element 468 and lower seal element 474 of the isolation packer 460 are in sealing engagement with the seal bore 446 of the isolator body 410. Fluid communication through the circulation port(s) 472 of the isolation packer 460 is thus inhibited.

Figure 6A:
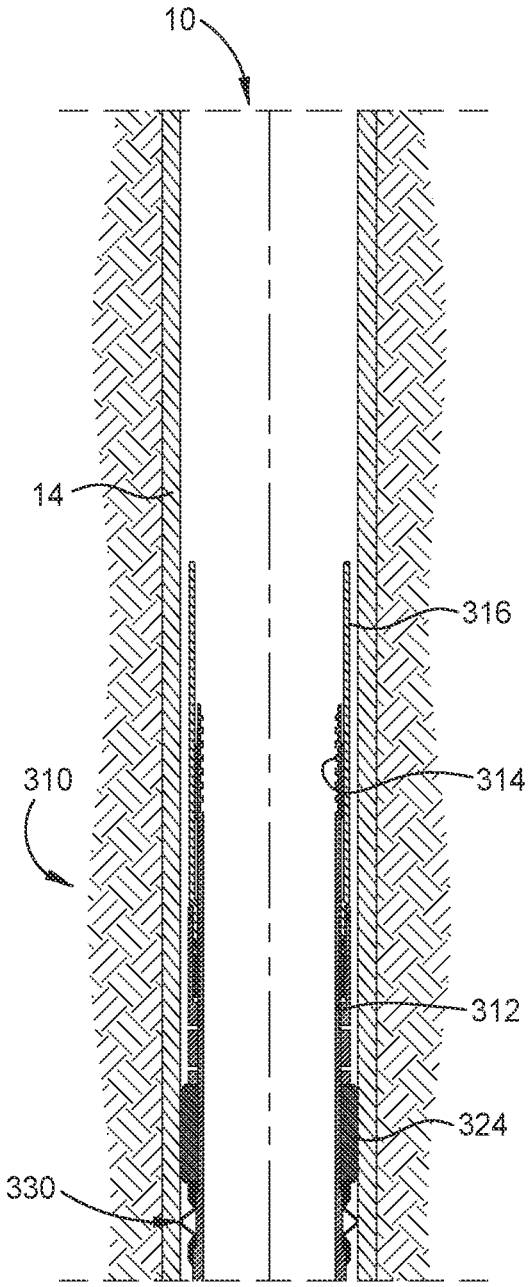
FIGS. 6A-6B provide a longitudinal cross-sectional view of a portion of the gravel pack system of FIGS. 1A-1D following a subsequent operation in the wellbore.
Figure 6B:
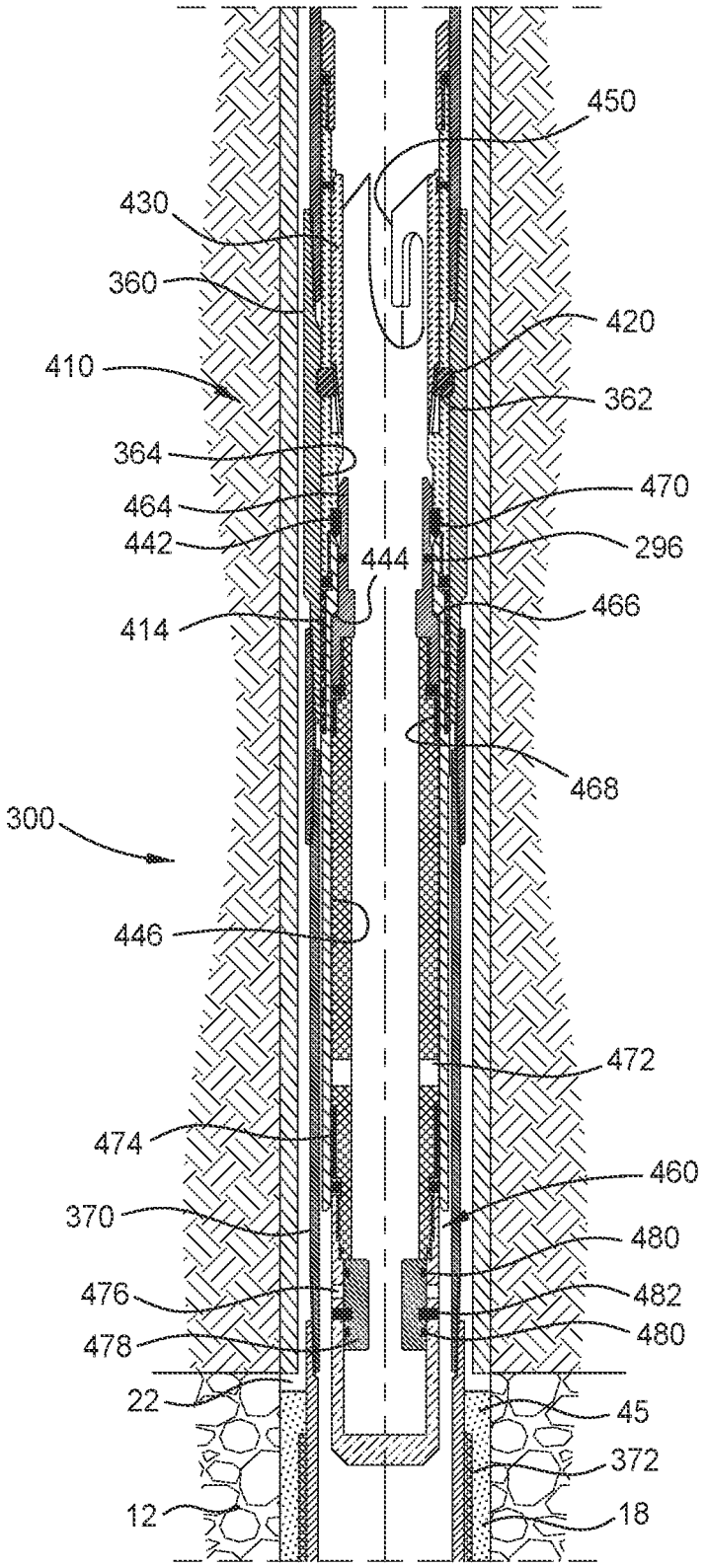

FIGS. 6A-6B illustrates a portion of the gravel pack system 1000 following an operation subsequent to engaging the isolation packer 460 with the isolator body 410. The operation includes manipulating the work string 16 to pull the deployment assembly 100 further upwards. Upward movement of the isolator body 410 is prevented by engagement of the one or more locking dogs 420 with the internal recess 362 of the locator sub 360. Upward movement of the isolation packer 460 with respect to the isolator body 410 is prevented by engagement of the shoulder 466 of the isolation packer 460 with the corresponding shoulder 444 of the isolator body 410. With the isolation packer 460 secured to the isolator body 410, further upward movement of the deployment assembly 100 results in the defeat (such as by unlatching, unlocking, flexing, shearing, or the like) of the fastener 296 that couples the fishing neck 464 of the isolation packer 460 to the tail pipe 294 that extends from the gravel pack valve 280. The deployment assembly 100 is then retrieved from the wellbore 10.

FIG. 6A shows the packer 310, and FIG. 6B shows the isolation assembly 400, after the deployment assembly 100 has been retrieved from the wellbore 10. Visible in FIG. 6B is J-slot 450 of the sleeve 430, which is utilized during subsequent retrieval of the isolation assembly 400 from the wellbore 10.

In the configuration shown in FIG. 6B, the isolation assembly 400 provides a barrier to fluid communication within the liner assembly 300 between the packer 310 and the liner 370 that is below the isolation assembly 400. Fluid communication between the locator sub 360 and the isolator body 410 is inhibited by the seal element 414 on the isolator body 410 bearing against the inner surface 364 of the locator sub 360. Fluid communication between the isolator body 410 and the isolation packer 460 is inhibited by the upper seal element 468 of the isolation packer 460 bearing against the seal bore 446 of the isolator body 410. Fluid communication to or from the liner 370 extending below the isolation assembly 400 through the circulation port(s) 472 of the isolation packer 460 is inhibited by the lower seal element 474 of the isolation packer 460 bearing against the seal bore 446 of the isolator body 410. Fluid communication to or from the liner 370 extending below the isolation assembly 400 through the dump port(s) 476 of the isolation packer 460 is inhibited by the sleeve 478 and seals 480.

Embodiments of the present disclosure facilitate liner running, gravel packing, and subsequent packer setting operations in a single trip into a wellbore. A deployment assembly facilitates rotation of a liner assembly and circulation through the liner assembly while running the liner assembly into the wellbore using a work string. A crossover tool of the deployment assembly enables the execution of a gravel packing operation without manipulation of the work string. A setting tool of the deployment assembly sets a packer at the top of the liner assembly such that manipulation of the packer during the setting operation facilitates rotational decoupling of the liner assembly from the deployment assembly. Subsequent rotation of the work string and the deployment assembly releases the deployment assembly from the liner assembly, enabling retrieval of the deployment assembly. Embodiments of the present disclosure provide for a simple and robust execution of the above operations.

Embodiments of the present disclosure provide for the provision of a fluid barrier in a liner in a wellbore after conducting a gravel packing operation. The fluid barrier is established during retrieval of a liner deployment assembly from a wellbore. Embodiments of the present disclosure provide for the running of a liner into a wellbore using a liner deployment assembly, the placement of a gravel pack around the liner, the establishment of a fluid barrier in the liner, and the retrieval of the liner deployment assembly in a single trip into the wellbore.

While the foregoing is directed to embodiments of the present disclosure, other and further embodiments of the disclosure may be devised without departing from the basic scope thereof, and the scope thereof is determined by the claims that follow.

What is claimed is:

1. A liner deployment assembly comprising:

a setting tool;

a crossover tool coupled to the setting tool, the crossover tool including:

a tubular mandrel including a longitudinal throughbore;

a first port through a wall of the tubular mandrel;

a first sleeve disposed around the tubular mandrel;

a bypass channel between the tubular mandrel and the first sleeve; and a second sleeve disposed in the longitudinal throughbore and including a seat, the second sleeve movable between:

a first position in which the second sleeve blocks fluid flow through the first port from the longitudinal throughbore, and blocks fluid flow through the bypass channel from the longitudinal throughbore; and a second position in which the second sleeve permits fluid flow through the first port from the longitudinal throughbore, and permits fluid flow through the bypass channel from the longitudinal throughbore; and a liner running sub coupled to the crossover tool, the liner running sub including:

a body;

a first thread on the body configured to engage a corresponding second thread of a liner assembly; and a first spline on the body configured to engage a corresponding second spline of the liner assembly;

wherein the first thread and the first spline are immovable relative to each other.

2. The liner deployment assembly of claim 1, wherein the body, the first thread, and the first spline of the liner running sub are formed as a unitary structure.

3. The liner deployment assembly of claim 1, wherein the first thread, and the first spline of the liner running sub are formed on separate sub-components of the body, the separate sub-components joined together to form the liner running sub.

4. The liner deployment assembly of claim 1, wherein the crossover tool further comprises:

a toggle disposed on the second sleeve, the toggle including a ring disposed around a pin;

wherein: when the second sleeve is in the first position, the ring extends to a radially outward position with respect to the second sleeve; and when the second sleeve is in the second position, the ring extends to a radially inward position with respect to the second sleeve.

5. The liner deployment assembly of claim 4, wherein when the second sleeve is in the first position, the ring extends into a recess of the tubular mandrel.

6. The liner deployment assembly of claim 1, further comprising: a packer assembly, the packer assembly including:

a packer mandrel including outwardly projecting splines;

a packer element disposed around the packer mandrel, the packer element movable between radially retracted and radially extended positions;

a setting sleeve disposed around the packer mandrel, the setting sleeve including a spring section disposed adjacent the packer element; and an actuation sleeve coupled to the setting sleeve and disposed around the packer mandrel, the actuation sleeve including inwardly projecting splines engaged with the outwardly projecting splines.

7. The packer of claim 6, further comprising a sand barrier disposed around the packer mandrel and adjacent the packer element, the sand barrier movable between radially retracted and radially extended positions, and comprising a deformable ring between first and second end caps.

8. The packer of claim 7, wherein: the packer element is axially movable along the packer mandrel to push the first end cap toward the second end cap.

9. The packer of claim 6, wherein: the setting sleeve is configured to move in a first axial direction along the packer mandrel to transition the packer element from the radially retracted position to the radially extended position; and when the packer element is in the radially extended position, the setting sleeve is prevented from moving in a second axial direction opposite the first axial direction along the packer mandrel by engagement of first ratchet teeth of a lock ring with second ratchet teeth on the packer mandrel.

10. The packer of claim 6, wherein the actuation sleeve is coupled to the setting sleeve by a shearable fastener.

11. The packer of claim 6, further comprising a thread on an inner surface of the packer mandrel, the thread configured to mate with a corresponding thread of a running tool.

12. The packer of claim 6, wherein the spring section includes overlapping slots formed in a wall of the setting sleeve, each slot extending partially around the setting sleeve.

* * * * *